US008823622B2

(12) United States Patent
Senda et al.

(10) Patent No.: US 8,823,622 B2
(45) Date of Patent: Sep. 2, 2014

(54) LIQUID CRYSTAL DISPLAY

(75) Inventors: Michiru Senda, Tokyo (JP); Ryoichi Yokoyama, Tokyo (JP)

(73) Assignee: Samsung Display Co., Ltd. (KR)

( * ) Notice: Subject to any disclaimer, the term of this patent is extended or adjusted under 35 U.S.C. 154(b) by 1242 days.

(21) Appl. No.: 11/933,232

(22) Filed: Oct. 31, 2007

(65) Prior Publication Data

US 2008/0224980 A1 Sep. 18, 2008

(30) Foreign Application Priority Data

Mar. 14, 2007 (KR) ..... 10-2007-0025207

(51) Int. Cl.
*G09G 3/36* (2006.01)

(52) U.S. Cl.
CPC ..... *G09G 3/3648* (2013.01); *G09G 3/3614* (2013.01); *G09G 2310/0218* (2013.01); *G09G 3/3677* (2013.01); *G09G 2310/08* (2013.01); *G09G 2340/16* (2013.01)
USPC ..... 345/96; 345/209; 345/87; 349/77; 349/78; 349/80; 349/104; 349/106

(58) Field of Classification Search
USPC ..... 345/213, 130, 131, 132, 77, 209, 345/87–104; 348/793; 349/77, 78, 80, 104, 349/106
See application file for complete search history.

(56) References Cited

U.S. PATENT DOCUMENTS 6,115,020 A * 9/2000 Taguchi et al. ..... 345/99
6,545,653 B1 * 4/2003 Takahara et al. ..... 345/87
6,933,910 B2 * 8/2005 Kodate et al. ..... 345/55
7,256,774 B1 * 8/2007 Senda et al. ..... 345/204
2002/0097214 A1 7/2002 Song
2003/0156092 A1 8/2003 Suzuki et al.
2004/0257322 A1 12/2004 Moon
2005/0122295 A1 * 6/2005 Sawabe ..... 345/88
2005/0219187 A1 10/2005 Shih
2005/0219188 A1 * 10/2005 Kawabe et al. ..... 345/94
2005/0275611 A1 12/2005 Aoki
2010/0164996 A1 * 7/2010 Tomizawa et al. ..... 345/690

FOREIGN PATENT DOCUMENTS

EP 0730258 A1 9/1996
EP 1492078 A3 12/2006
JP 03-132274 A 6/1991
JP 2002-182620 A 6/2002
JP 2002214631 7/2002
JP 2003-143556 A 5/2003
JP 2004-212610 A 7/2004
JP 2004-264725 A 9/2004
JP 2005292793 10/2005
JP 2005-309326 A 11/2005

(Continued)

*Primary Examiner* — Olga Merkoulova
(74) *Attorney, Agent, or Firm* — Cantor Colburn LLP

(57) ABSTRACT

A liquid crystal display includes a plurality of gate lines having odd-numbered gate lines and even-numbered gate lines, a plurality of source lines, a first gate driver which drives the odd-numbered gate lines, a second gate driver which drives the even-numbered gate lines and a driving controller which outputs an overdriven image signal in at least one driving period of a plurality of driving periods and outputs a normal image signal in remaining driving periods of the plurality of driving periods. The overdriven image signal is obtained by adding an overdrive voltage to the normal image signal, and the overdrive voltage is set according to a level of the normal image signal.

24 Claims, 20 Drawing Sheets

(56) References Cited

FOREIGN PATENT DOCUMENTS

| | | | | | |
|---|---|---|---|---|---|
| JP | 2006071891 | | 3/2006 | | |
| JP | 2006106062 | | 4/2006 | | |
| KR | 1020020045017 | A | 6/2002 | | |
| KR | 1020040036259 | A | 4/2004 | | |
| WO | 2006126373 | A1 | 11/2006 | | |
| WO | 2007018219 | A1 | 2/2007 | | |
| WO | WO 2007/018219 | A1 * | 2/2007 | ..... | H04N 5/66 |

* cited by examiner

LIQUID CRYSTAL DISPLAY

This application claims priority to Korean Patent Application No. 2007-25207, filed on Mar. 14, 2007, and all the benefits accruing therefrom under 35 U.S.C. §119, the contents of which in its entirety are herein incorporated by reference.

BACKGROUND OF THE INVENTION

1. Field of the Invention

The present invention relates to a liquid crystal display ("LCD"), and more particularly, to an LCD which uses a dot inversion driving method and an overdrive driving method.

2. Description of the Related Art

A thin film transistor ("TFT") LCD panel using a TFT is widely used in electronic appliances such as cellular telephones, personal computers and electric home appliances. In order to improve display quality of an image and/or to reduce power consumption, a TFT LCD panel uses a dot inversion driving method in which a polarity of a voltage applied to adjacent pixels is inverted, or an overdrive driving method in which a response time of liquid crystal is shortened by overlapping voltage with image signals.

In the LCD using the dot inversion driving method disclosed in Japanese Unexamined Patent Publication No. 2006-71891, pixels are arranged in a substantially lattice structure, and a polarity of a voltage applied to a pixel is inverted every one frame and data line.

In an active matrix-type LCD using the dot inversion driving method disclosed in Japanese Unexamined Patent Publication No. 2006-106062, each pixel includes four sub-pixels arranged substantially in a row direction along scanning lines. Switching devices which control adjacent sub-pixels having the same color are connected to different scanning lines, and a polarity of data signals output to a given signal line are inverted whenever a selected scanning line is changed.

An LCD using the overdrive driving method disclosed in Japanese Unexamined Patent Publication No. 2005-292793 is driven in a manner such that a precharge voltage is applied to a scanning line before pixels connected to the scanning line are turned on, and a bias is applied to the scanning line according to a voltage of a common electrode.

However, the dot inversion driving method and the overdrive driving method used for the LCDs disclosed in the Japanese Unexamined Patent Application Publications described above are only suitable for a large-sized TFT LCD panel having a corresponding large-sized circuit structure and high power capacity, and are therefore not suitable for a medium or a small-sized TFT LCD panel having a small-sized circuit structure and low power consumption requirement.

BRIEF SUMMARY OF THE INVENTION

The present invention provides a liquid crystal display ("LCD") having a dot inversion driving method and an overdrive driving method applicable in a medium-and/or small-sized thin film transistor ("TFT") LCD panel, improving the display quality of the medium or small-sized TFT LCD panel, and reducing power consumption and manufacturing cost of the medium or small-sized TFT LCD panel.

In one exemplary embodiment of the present invention, a liquid crystal display includes a plurality of gate lines having odd-numbered gate lines and even-numbered gate lines, a plurality of source lines, a first gate driver which drives the odd-numbered gate lines, a second gate driver which drives the even-numbered gate lines and a driving controller. The driving controller outputs an overdriven image signal, obtained by adding an overdrive voltage to a normal image signal, in at least one driving period of a plurality of driving periods of the first gate driver and the second gate driver and outputs the normal image signal in remaining driving periods of the plurality of driving periods of the first gate driver and the second gate driver, wherein the overdrive voltage is set according to a level of the normal image signal. The plurality of gate lines extends in a first direction and the plurality of source lines extends in a second direction substantially perpendicular to the first direction. The first gate driver and the second gate driver alternately drive the odd-numbered gate lines and the even-numbered gate lines, respectively, twice each per image display period. The driving controller outputs the overdriven image signal to a source driver during a first driving period of the plurality of driving periods. The overdrive voltage is set according to a level of a normal image signal to be displayed in a second driving period of the plurality of driving periods.

The driving controller includes a frame memory, a line memory and an overdrive voltage setup unit. The frame memory includes first and second memory areas, each of which stores a half-screen image signal every driving period of the plurality of driving periods. The line memory stores a one-line image signal. The overdrive voltage setup unit compares a level of a previous half-screen image signal stored in the first memory area or the second memory area to a level of a present one-line image signal stored in the line memory, and sets the overdrive voltage based on a result obtained by comparing the level of the previous half-screen image to the level of the present one-line image signal.

The overdrive voltage setup unit includes an image signal comparator and an overdrive voltage storage unit. The image signal comparator compares the level of the previous half-screen image signal stored in the first memory area or the second memory area to the level of the one-line image signal stored in the line memory, and outputs a voltage difference thereof. The overdrive voltage storage unit stores the overdrive voltage based on the voltage difference output from the image signal comparator, an absolute value of the voltage difference output from the image signal comparator and the previous half-screen image signal.

The driving controller outputs the half-screen image signal stored in the first memory area or the second memory area to the source driver as the normal image signal in the remaining driving periods of the first gate driver and in the remaining driving periods of the second gate driver.

The driving controller inverts a polarity of the overdriven image signal and a polarity of the normal image signal every driving period of the first gate driver and every driving period of the second gate driver.

The driving controller inverts a polarity of the overdriven image signal and a polarity of the normal image signal in the first driving period and the second driving period of the plurality of driving periods such that a polarity of the overdriven image signal is opposite to a polarity of the normal image signal during the first driving period and the second driving period.

The liquid crystal display may further include a plurality of pixels disposed in first columns and second columns, wherein the first columns and the second columns are aligned in the second direction, the first gate driver is installed at an end portion of the odd-numbered gate lines and the second gate driver is installed at an end portion of the even-numbered gate lines opposite to the end portion of the odd-numbered gate lines.

In another exemplary embodiment of the present invention, a liquid crystal display includes a plurality of gate lines having odd-numbered gate lines and even-numbered gate lines, a plurality of source lines, a first gate driver, a second gate driver, a driving controller and a source driver.

The plurality of gate lines extends in a first direction and the source lines extend in a second direction substantially perpendicular to the first direction.

The first gate driver divides a scanning period, in which a half-screen image signal is scanned, into a plurality of driving periods having a first driving period and a second driving period, and drives the odd-numbered gate lines during the first driving period.

The second gate driver drives the even-numbered gate lines during the second driving period.

The driving controller outputs an overdriven image signal, obtained by adding an overdrive voltage to a normal image signal, in at least one driving period of the plurality of driving periods, and outputs the normal image signal in remaining driving periods of the plurality of driving periods, in which the overdrive voltage is set according to a level of the normal image signal and the normal image signals are not overdriven.

The source driver drives the source lines based on the overdriven image signal and the normal image signal.

The first gate driver and the second gate driver alternately drive the odd-numbered gate lines the even-numbered gate lines, respectively, in the first driving period and the second driving period, respectively, and the driving controller outputs the overdriven image signal to the source driver during the first driving period and outputs the normal image signal to the source driver during the second driving period.

The driving controller inverts a polarity of the overdriven image signals and a polarity of the normal image signal every driving period of the plurality of driving periods.

The first and second gate drivers may further divide the scanning period, in which the half-screen image signal is scanned, into the first driving period, the second driving period, a third driving period and a fourth driving period, and the first gate driver and the second gate driver may alternately drive the odd-numbered gate lines and the even-numbered gate lines, respectively. The driving controller may output the overdriven image signal to the source driver during the first driving period and the second driving period and output the normal image signal to the source driver during the third driving period and the fourth driving period.

The driving controller inverts a polarity of the overdriven image signal and a polarity of the normal image signal every two consecutive driving periods of the first driving period, the second driving period, the third diving period and the fourth driving period.

The driving controller includes a frame memory, a line memory and an overdrive voltage setup unit.

The frame memory includes a first memory area and a second memory area, each of which stores the half-screen image signal every driving period of the plurality of driving periods, and the line memory stores a one-line image signal. The overdrive voltage setup unit compares a level of a previous half-screen image signal stored in the first memory area or the second memory area to a level of a present one-line image signal stored in the line memory, and sets an overdrive voltage based on a result obtained by comparing the level of the previous half-screen image signal to the level of the present one-line image signal.

The overdrive voltage setup unit includes an image signal comparator and an overdrive voltage storage unit.

The image signal comparator compares the level of the previous half-screen image signal stored in the first memory area or the second memory area to the level of the one-line image signal stored in the line memory, and outputs a voltage difference thereof.

The overdrive voltage storage unit stores the overdrive voltage based on the voltage difference output from the image signal comparator, an absolute value of the voltage difference output from the image signal comparator, and the previous half-screen image signal.

The liquid crystal display may further include a plurality of pixels disposed in first columns and second columns, wherein the first columns and the second columns are aligned in the second direction, the first gate driver is installed at an end portion of the odd-numbered gate lines and the second gate driver is installed at an end portion of the even-numbered gate lines opposite to the end portion of the odd-numbered gate lines.

In yet another exemplary embodiment of the present invention, a liquid crystal display includes a plurality of gate lines, a plurality of source lines, a gate driver which drives the gate lines in a scanning period during which an image signal of one screen is scanned, a driving controller which drives the gate lines in a scanning period during which an image signal of one screen is scanned and a source driver which drives the source lines based on the image signal.

The plurality of gate lines extends in a first direction and the plurality of source lines extend in a second direction substantially perpendicular to the first direction.

The driving controller outputs an overdriven image signal, obtained by adding an overdrive voltage to a normal image signal, to the source driver in the scanning period.

The driving controller includes a frame memory, a line memory and an overdrive voltage setup unit.

The frame memory stores an image signal of one screen, and the line memory stores an image signal of one line.

The overdrive voltage setup unit compares a level of a previous image signal of one screen stored in the frame memory to a level of a present image signal of one line stored in the line memory and sets an overdrive voltage based on a result obtained by comparing the level of the previous image signal of one screen to the level of the present image signal of one line.

The overdrive voltage setup unit includes an image signal comparator and an overdrive voltage storage unit.

The image signal comparator compares the level of the image signal of one screen stored in the frame memory to the level of the image signal of one line stored in the line memory, and outputs a voltage difference thereof.

The overdrive voltage storage unit stores the overdrive voltage based on the voltage difference output from the image signal comparator, an absolute value of the voltage difference output from the image signal comparator, and the level of the previous image signal of one screen.

The liquid crystal display may further include a plurality of pixels disposed in first columns and second columns, wherein the first columns and the second columns are aligned in the second direction and the gate driver is disposed at an end portion of the gate lines.

BRIEF DESCRIPTION OF THE DRAWINGS

The above and other aspects, features and advantages of the present invention will become more readily apparent by describing in further detail exemplary embodiments thereof with reference to the accompanying drawings, in which.

DETAILED DESCRIPTION OF THE INVENTION

Figure 1:
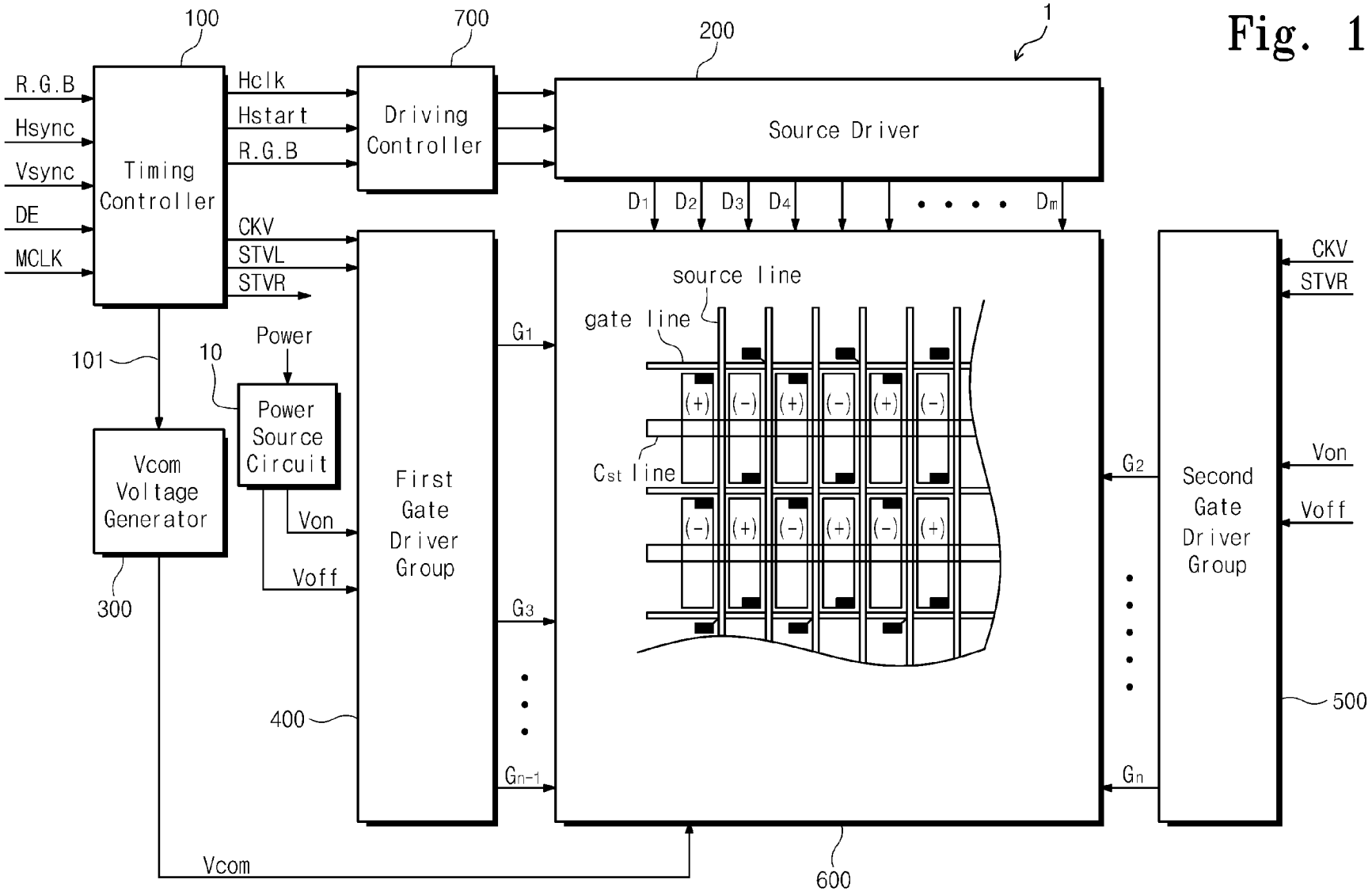
FIG. 1 is a block diagram of a liquid crystal display ("LCD") according to a first exemplary embodiment of the present invention.

The invention will now be described more fully hereinafter with reference to the accompanying drawings, in which exemplary embodiments of the invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including," when used in this specification, specify the presence of stated features, regions, integers, steps, operations, elements and/or components, but do not preclude the presence or addition of one or more other features, regions, integers, steps, operations, elements, components and/or groups thereof.

Furthermore, relative terms, such as "lower" or "bottom" and "upper" or "top" may be used herein to describe one element's relationship to other elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on the "upper" side of the other elements. The exemplary term "lower" can, therefore, encompass both an orientation of "lower" and "upper," depending upon the particular orientation of the figure. Similarly, if the device in one of the figures were turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning which is consistent with their meaning in the context of the relevant art and the present disclosure, and will not be interpreted in an idealized or overly formal sense unless expressly so defined herein.

Exemplary embodiments of the present invention are described herein with reference to cross section illustrations which are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes which result, for example, from manufacturing. For example, a region illustrated or described as flat may, typically, have rough and/or nonlinear features. Moreover, sharp angles which are illustrated may be rounded. Thus, the regions illustrated in the figures are schematic in nature and their shapes are not intended to illustrate the precise shape of a region and are not intended to limit the scope of the present invention.

The present invention will now be described in further detail with reference to the accompanying drawings.

Figure 2:
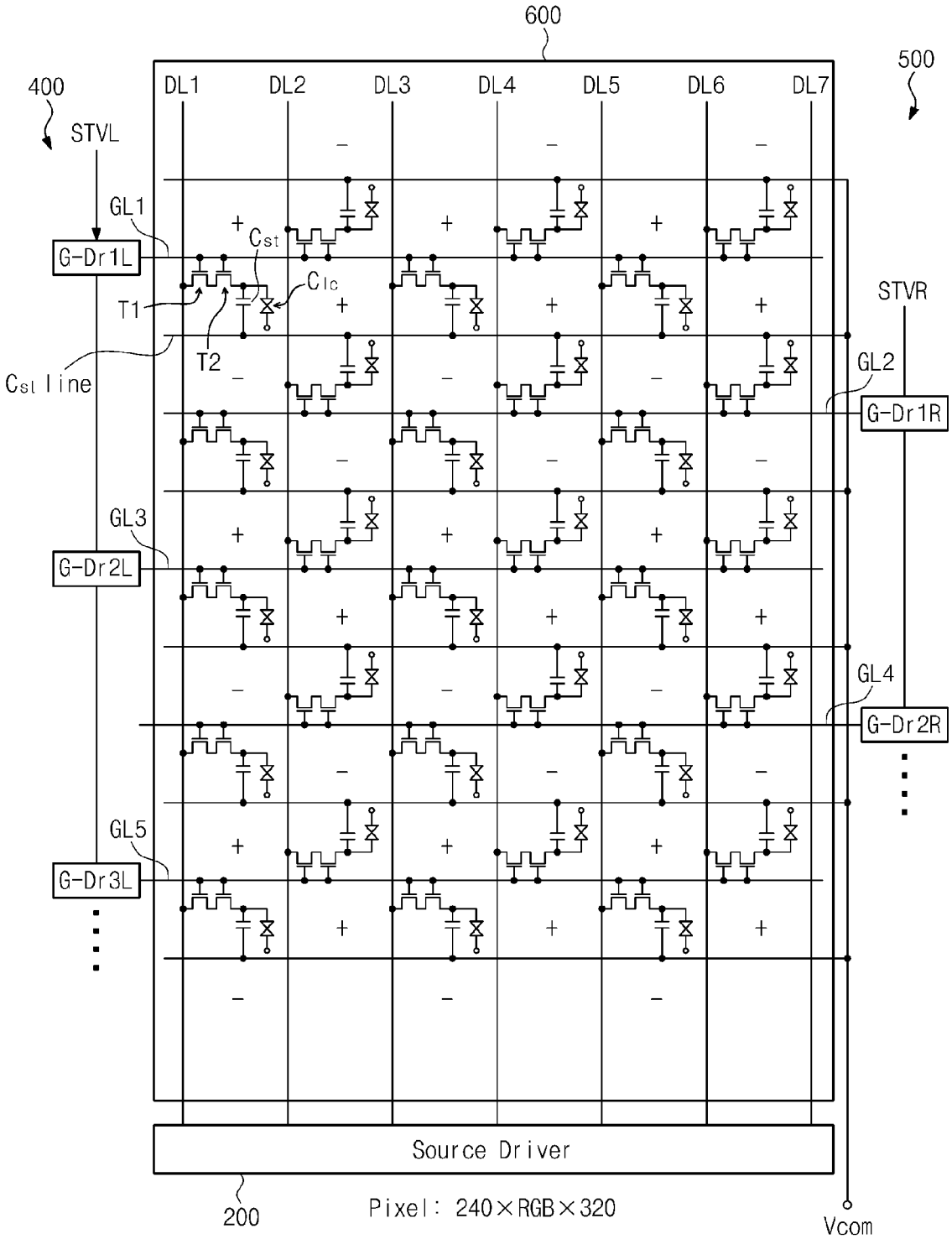
FIG. 2 is a schematic circuit diagram of an LCD panel according to the first exemplary embodiment of the present invention in FIG. 1.

FIG. 1 is a block diagram of a liquid crystal display ("LCD") according to a first exemplary embodiment of the present invention. FIG. 2 is a schematic circuit diagram of an LCD panel according to the first exemplary embodiment of the present invention in FIG. 1.

Referring to FIG. 1, the LCD 1 includes a power source circuit 10, a timing controller 100, a source driver 200, a first gate driver group 400, a second gate driver group 500, a Vcom voltage generator 300, an LCD panel 600 and a driving controller 700.

The timing controller 100 outputs a first signal 101 which sets a period and an amplitude of a common electrode voltage Vcom to the Vcom voltage generator 300 according to a vertical synchronization signal Vsync, a horizontal synchronization signal Hsync and a main clock signal MCLK, which are input from an outside source. Further, the timing controller 100 receives a data enable signal DE and an image data signal R.G.B and outputs a horizontal clock signal Hclk, a horizontal start signal Hstart and the image data signal R.G.B (hereinafter collectively referred to as "source driver driving signals") to the driving controller 700, and outputs a clock signal Gate Clk (hereinafter referred to as "CKV") and a first gate start signal STVL to the first gate driver group 400, and the clock Gate Clk and a second gate start signal STVR to the second gate driver group 500, as shown in FIG. 1. Hereinafter, the clock signal CKV, the first gate start signal STVL and the second gate start signal STVR are collectively referred to as "gate driver driving signals."

The source driver 200 outputs data voltages $D_1$ to $D_m$, which drive a liquid crystal capacitor $C_{lc}$ (not shown) in the LCD panel 600, to source lines of the LCD panel 600 based on image data received from the driving controller 700.

The power source circuit 10 receives a power and generates a gate on voltage Von and a gate off voltage Voff (hereinafter collectively referred to as "gate driver driving voltages Von and Voff") based on a supply voltage input when the LCD 1 is powered on, and outputs the gate on voltage Von and the gate off voltage Voff to the first gate driver group 400 and the second gate driver group 500. The Vcom voltage generator 300 generates a common electrode voltage Vcom using the clock signal 101, which is input from the timing controller 100, and outputs the common electrode voltage Vcom to the LCD panel 600.

As illustrated in FIG. 2, the first gate driver group 400 and the second gate driver group 500 are disposed at the left and right lateral sides of the LCD panel 600, respectively. The first gate driver group 400 includes a plurality of first gate drivers G-Dr1L to G-Dr(n/2)L which drive odd-numbered gate lines GL1, GL3, GL5, . . . of a plurality of n gate lines extending in a first direction, the first direction being substantially horizontal, as shown in FIGS. 1 and 2. The second gate driver group 500 includes a plurality of second gate drivers G-Dr1R to G-Dr(n/2)R which drive even-numbered gate lines GL2, GL4, . . . of the plurality of n gate lines. The plurality of first gate drivers sequentially outputs gate driving voltages $G_1$, $G_3$, . . . , and $G_{(n-1)}$ to the odd-numbered gate lines GL1, GL3, GL5, . . . based on the gate driver driving signals CKV and STVL input from the timing controller 100 and the gate driver driving voltages Von and Voff input from the power source circuit 10. Likewise, the plurality of second gate drivers sequentially outputs gate driving voltages $G_2$, $G_4$, . . . , and $G_n$ to the even-numbered gate lines GL2, GL4, . . . based on the gate driver driving signals CKV and STVR input from the timing controller 100 and the gate driver driving voltages Von and Voff input from the power source circuit 10.

As shown in FIG. 2, the source driver 200 is installed at a lower lateral side of the LCD panel 600.

Referring again to FIGS. 1 and 2, the LCD panel 600 includes a plurality of gate lines, a plurality of source lines, a plurality of common electrode lines Cst line, a plurality of first switching devices T1, a plurality of second switching devices T2 a plurality of the liquid crystal capacitors $C_{lc}$ and a plurality of storage capacitors $C_{st}$. The gate lines extend in the first direction, e.g., a substantially horizontal direction, and the source lines extend in a second direction substantially perpendicular to the first direction, e.g., a vertical direction, and cross the gate lines. The common electrode lines Cst line cross the source lines, and the first and second switching devices T1, hereinafter referred to as first and second thin film transistors ("TFTs") T2, are commonly connected to a corresponding gate line from among the plurality of n gate lines. The LCD panel 600 displays an image corresponding to the data voltages $D_1$ to $D_m$, which are input from the source driver 200 in response to the gate driving voltages $G_1$, $G_3$, . . . , and $G_{(n-1)}$ input from the first gate driver group 400 and the gate driving voltages $G_2$, $G_4$, . . . , and $G_n$ input from the second gate driver group 500, and the common electrode voltage Vcom input from the Vcom voltage generator 300.

In an exemplary embodiment of the present invention, the LCD panel 600 has a pixel construction of 240*RGB (horizontal)*320 (vertical).

In the LCD panel 600 as illustrated in FIG. 2, the pixels are arranged in a substantially matrix pattern having even and odd pixels corresponding to even and odd gate lines, respectively, aligned in the first direction, as described above. The odd-numbered gate lines GL1, GL3, GL5, . . . of the plurality of n gate lines receive the gate driving voltages $G_1$, $G_3$, . . . , and $G_{(n-1)}$ from the first gate driver group 400, and the even-numbered gate lines GL2, GL4, . . . receive the gate driving voltages $G_2$, $G_4$, . . . , and $G_n$ from the second gate driver group 500. The source lines DL1, DL2, . . . arranged in the second direction receive the data voltages $D_1$ to $D_m$ from the source driver 200. Individual storage capacitors $C_{st}$ of the plurality of storage capacitors $C_{st}$ are connected to a respective common electrode line Cst line arranged between two adjacent associated gate lines, and receive the common electrode voltage Vcom input from the Vcom voltage generator 300.

The first TFT T1 and the second TFT T2 are aligned in a region defined by the gate lines and the source lines. Gate terminals (not shown) of the first TFT T1 and the second TFT T2 are connected to the gate lines, source terminals (not shown) of the first TFTs T1 are connected to the source lines and source terminals (not shown) of the second TFTs T2 are connected to drain electrodes (not shown) of the first TFTs T1. Drain terminals (not shown) of the second TFTs T2 are connected to the liquid crystal capacitors $C_{lc}$ and the storage capacitors $C_{st}$. Accordingly, the first TFTs T1 and the second TFTs T2 are turned on or off in response to the gate driving voltages $G_1$ to $G_n$ (FIG. 1) input through the gate lines.

The liquid crystal capacitor $C_{lc}$ transmits light provided from a backlight (not shown) in proportion to the data voltages $D_1$ to $D_m$ from the source driver 200. The storage capacitor $C_{st}$ charges to the data voltages $D_1$ to $D_m$ input from the source driver 200 when the first and second TFTs T1, T2 are turned on, and maintains the charged data voltage on the liquid crystal capacitor $C_{lc}$ when the first TFT T1 and the second TFT T2 are turned off.

Hereinafter, the configuration of the driving controller 700 will be described in further detail with reference to FIG. 3.

Figure 3:
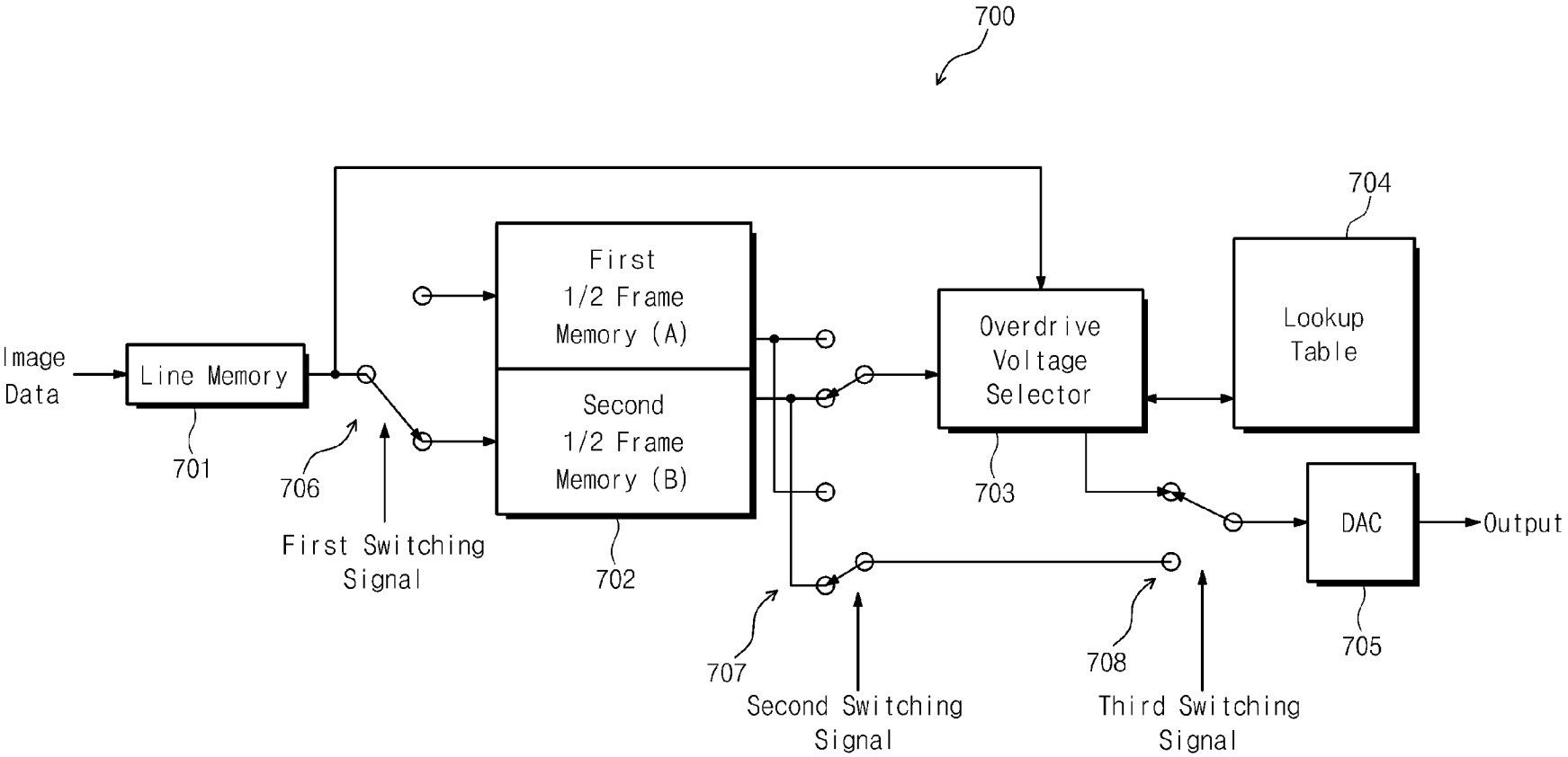
FIG. 3 is a block diagram of a driving controller of an LCD according to the first exemplary embodiment of the present invention in FIG. 1.

FIG. 3 is a block diagram of the driving controller 700 of the LCD 1 according to the first exemplary embodiment of the present invention in FIG. 1.

Referring to FIG. 3, the driving controller 700 includes a line memory 701, a frame memory 702, an overdrive voltage selector 703, a lookup table ("LUT") 704, a digital-to-analog converter ("DAC") 705, an image input switch 706, an image output switch 707 and an overdrive voltage output switch 708.

The line memory 701 stores one line of image data from the timing controller 100, and outputs the stored image data corresponding to one line to the image input switch 706 and the overdrive voltage selector 703.

The frame memory 702 includes a first ½ frame memory (A) and a second ½ frame memory (B). The first ½ frame memory (A) stores the image data of ½ screen corresponding to a first period in which the odd-numbered gate lines are driven, and the second ½ frame memory (B) stores the image data of ½ screen corresponding to a second period in which the even-numbered gate lines are driven. The first ½ frame memory (A) and the second ½ frame memory (B) output the image data of a respective ½ screen to the image output switch 707.

The overdrive voltage selector 703 compares a first voltage level of the image data of one line input from the line memory 701 with a second voltage level of the image data of ½ screen input from the image output switch 707, and selects an overdrive voltage preset in the lookup table 704 based on both an absolute value of a voltage difference between the first and second voltage levels which is obtained by comparing the first and second voltage levels, and the voltage level of the image data of ½ screen, thereby outputting image data, to which the selected overdrive voltage is applied, to the overdrive voltage output switch 708 to be output by the DAC 705 as described in further detail below.

The lookup table 704 includes an overdrive voltage preset based on the voltage difference of the image data output from the overdrive voltage selector 703 and the absolute value of the voltage difference between the first and second voltage levels.

Hereinafter, a method of the generating overdrive voltage will be described with reference to FIGS. 3 and 4.

Figure 4:
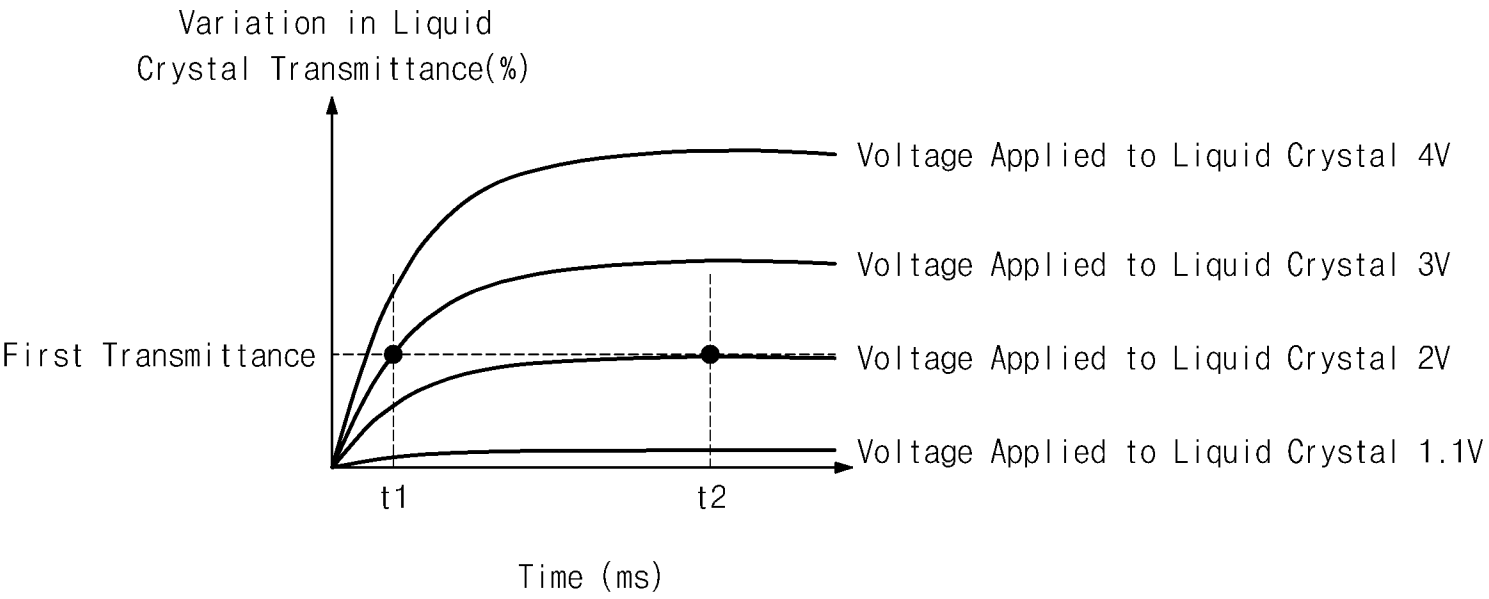
FIG. 4 is a graph of transmittance versus time illustrating a variance of a liquid crystal transmittance according to a voltage applied to the liquid crystal according to the first exemplary embodiment of the present invention in FIG. 1.

FIG. 4 is a graph of transmittance versus time illustrating a variation of a liquid crystal transmittance according to a voltage applied to liquid crystal according to the first exemplary embodiment of the present invention in FIG. 1, e.g., the transmission efficiency of liquid crystal when the voltage level applied to the liquid crystal is increased up to 2V, 3V and 4V from a voltage level of 1.1V. As illustrated in FIG. 4, when 2V is applied to the liquid crystal, a time required for reaching a first transmittance is t2 milliseconds ("ms"). When 3V is applied to the liquid crystal, a time required for reaching the first transmittance is t1 ms. Thus, as the voltage applied to the liquid crystal is increased, a response time of the liquid crystal is reduced, e.g., t1 is less than t2. A voltage difference of the image data corresponds to a voltage difference between a voltage level of the image data previously applied to the liquid crystal capacitor $C_{lc}$, described in greater detail above, and a voltage level of the image data currently applied to the liquid crystal capacitor $C_{lc}$. The overdrive voltage corresponding to both the absolute value of the voltage difference and the voltage level of the image data of ½ screen is set in the lookup table 704 such that when an overdrive voltage is applied to the image data, the response time of the liquid crystal is reduced in an LCD according to an exemplary embodiment of the present invention, as described in further detail below.

The DAC 705 converts overdriven image data or normal image data, e.g., image data which is not overdriven, input from the overdrive voltage output switch 708, into a source driving voltage and outputs the source driving voltage to the source driver 200 (FIGS. 1 and 2).

Referring again to FIG. 3, the image input switch 706 performs a switching operation in response to a first switching signal generated based on the gate driver driving signals input from the timing controller 100. More specifically, the image input switch 706 connects an output terminal of the line memory 701 to an input terminal of the first ½ frame memory (A) during the first period in which the odd-numbered gate lines driven, and connects the output terminal of the line memory 701 to an input terminal of the second ½ frame memory (B) during the second period in which the even-numbered gate lines are driven, so that image data is stored in the first ½ frame memory (A) and the second ½ frame memory (B) in response to the first switching signal.

The image output switch 707 performs a switching operation in response to a second switching signal generated based on the gate driver driving signals input from the timing controller 100. The image output switch 707 connects an output terminal of the first ½ frame memory (A) to an input terminal of the overdrive voltage selector 703 during a first sub-driving period of the first period in which the odd-numbered gate lines are driven, and connects the output terminal of the first ½ frame memory (A) to an input terminal of the overdrive voltage output switch 708 during a second sub-driving period of the first period in which the odd-numbered gate lines are driven. Likewise, the image output switch 707 connects an output terminal of the second ½ frame memory (B) to the input terminal of the overdrive voltage selector 703 during the first sub-driving period of the second period in which the even-numbered gate lines are driven, and connects the output terminal of the second ½ frame memory (B) to the input terminal of the overdrive voltage output switch 708 during the second sub-driving period of the second period in which the even-numbered gate lines are driven.

Finally, the overdrive voltage output switch 708 performs a switching operation in response to a third switching signal generated based on the gate driver driving signals input from the timing controller 100. More specifically, the overdrive voltage output switch 708 connects an output terminal of the overdrive voltage selector 703 to an input terminal of the DAC 705 during the first sub-driving period of the first period in which the odd-numbered gate lines are driven and during the first sub-driving period of the second period in which the even-numbered gate lines are driven. The overdrive voltage output switch 708 connects the output terminal of the first ½ frame memory (A) and the output terminal of the second ½ frame memory (B) to the input terminal of the DAC 705 during the second sub-driving period of the first period in which the odd-numbered gate lines are driven and during the second sub-driving period of the second period in which the even-numbered gate lines are driven.

Hereinafter, an operation of the LCD 1 according to the first exemplary embodiment of the present invention will be described in further detail with reference to FIGS. 5 through 10.

The LCD 1 according to an exemplary embodiment of the present invention employs a dot inversion driving mode in which the first gate driver group 400 and the second gate driver group 500 are alternately driven for a first driving period and a second driving period, respectively, of an image display period during which the image data of one screen are displayed, and a polarity of the image data is reversed for adjacent first and second driving periods. Further, during the second driving period, the LCD 1 performs an overdrive driving mode in which image data which are overdriven based on the image data of the first driving period are output to the source driver 200.

Figure 5:
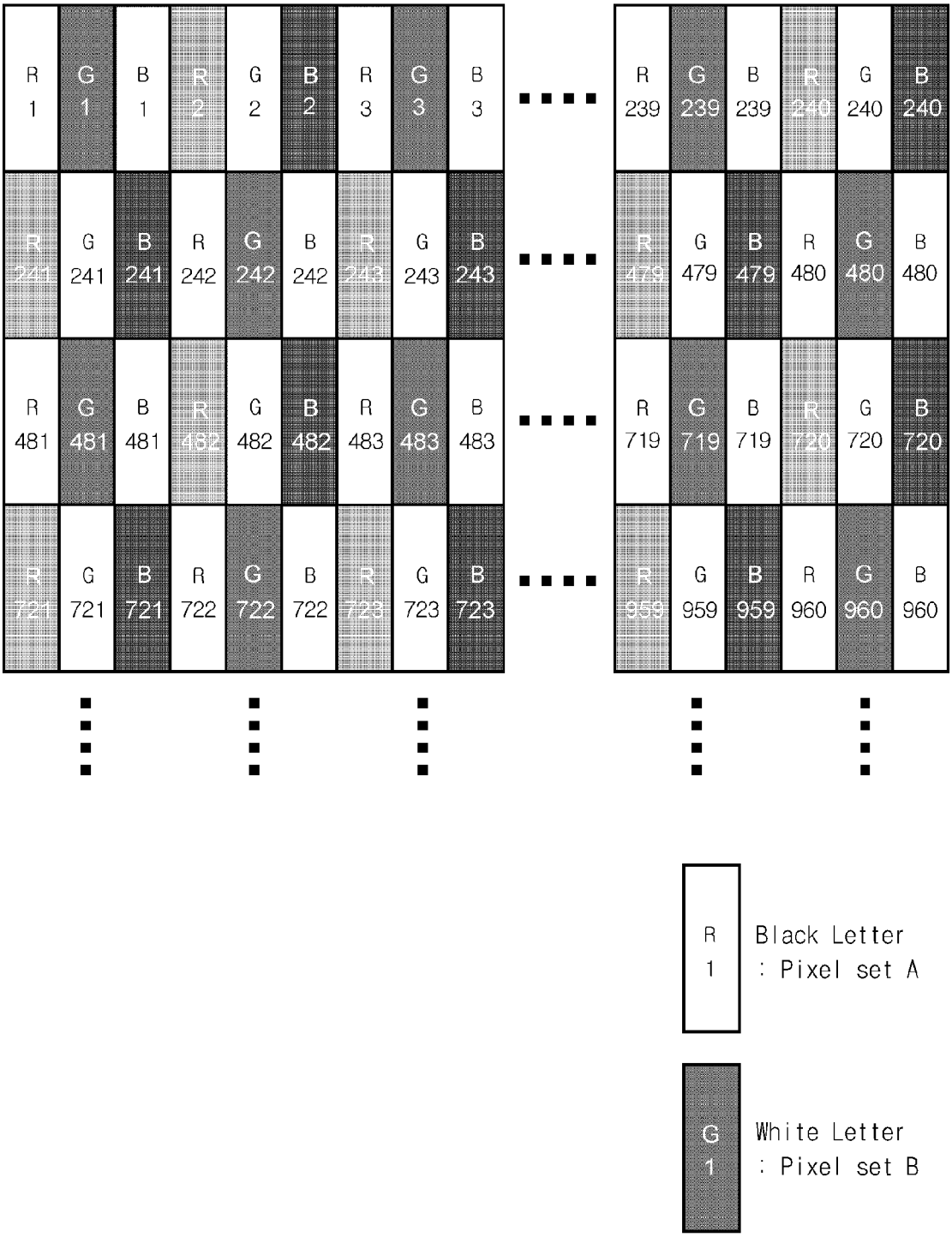
FIG. 5 is a view of a pixel alignment of an LCD panel according to the first exemplary embodiment of the present invention in FIG. 1.

FIG. 5 is a view of a pixel alignment of an LCD panel according to the first exemplary embodiment of the present invention in FIG. 1. A pixel alignment of the LCD panel 600 (FIG. 2) will hereinafter be described in further detail with reference to FIG. 5.

Referring to FIG. 5, each pixel includes red sub-pixels R, green sub-pixels G and blue sub-pixels B. In FIG. 5 and hereinafter, the labels for the red sub-pixels R, the green sub-pixels G and the blue sub-pixels B are written as either a black letter or a white letter, with the black letter and the white letter referring to pixel sets A and B, respectively. The pixel set A receives image data during the first driving period of the first gate driver group 400 and the pixel set B receives image data during the second driving period of the second gate driver group 500. Further referring to FIG. 5, numerals written below each sub-pixel denote a position of the respective sub-pixel in the LCD panel 600 (FIG. 2).

Hereinafter, a case in which a dot inversion driving mode is applied to the pixel set A and the pixel set B in FIG. 5 will be described in further detail with reference to FIGS. 5, 6 and 7.

Figure 6:
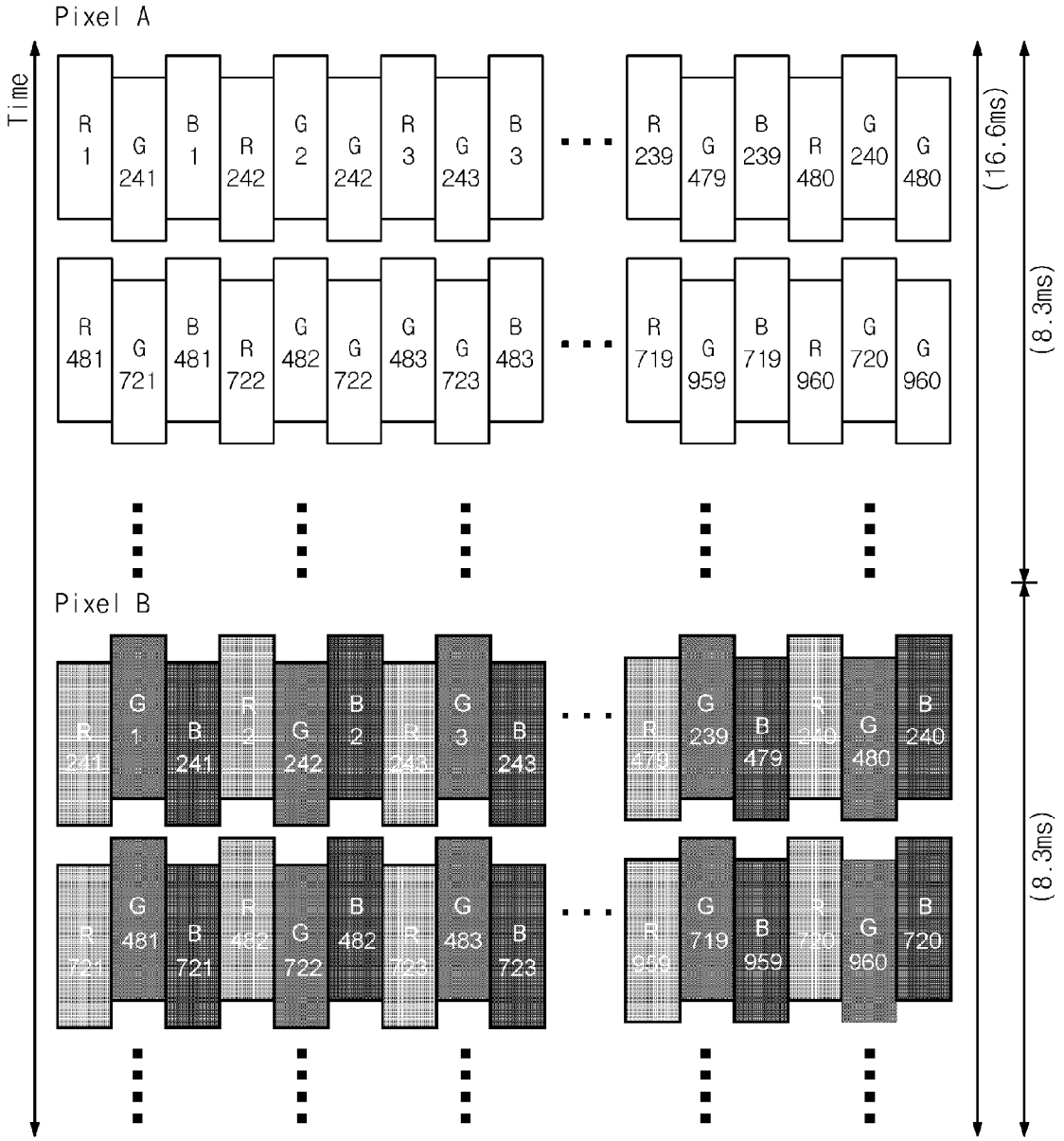
FIG. 6 is a view of a set of pixels illustrating odd-numbered gate lines and even-numbered gate lines driven according to the first exemplary embodiment of the present invention in FIG. 1.

FIG. 6 is a view of a set of pixels illustrating odd-numbered gate lines rows and even-numbered gate lines driven according to the first exemplary embodiment of the present invention in FIG. 1.

Referring to FIG. 6, odd-numbered gate lines corresponding to the pixel set A are driven during a first driving period (8.3 ms) and even-numbered gate lines corresponding to the pixel set B are driven during a second driving period (8.3 ms). That is, odd-numbered gate lines corresponding to the pixel set A and even-numbered gate lines corresponding to the pixel set B are alternatively driven twice during a time period of 16.6 ms, e.g., 332 horizontal periods H ("332H") which an image corresponding to ½ screen is displayed.

Figure 7:
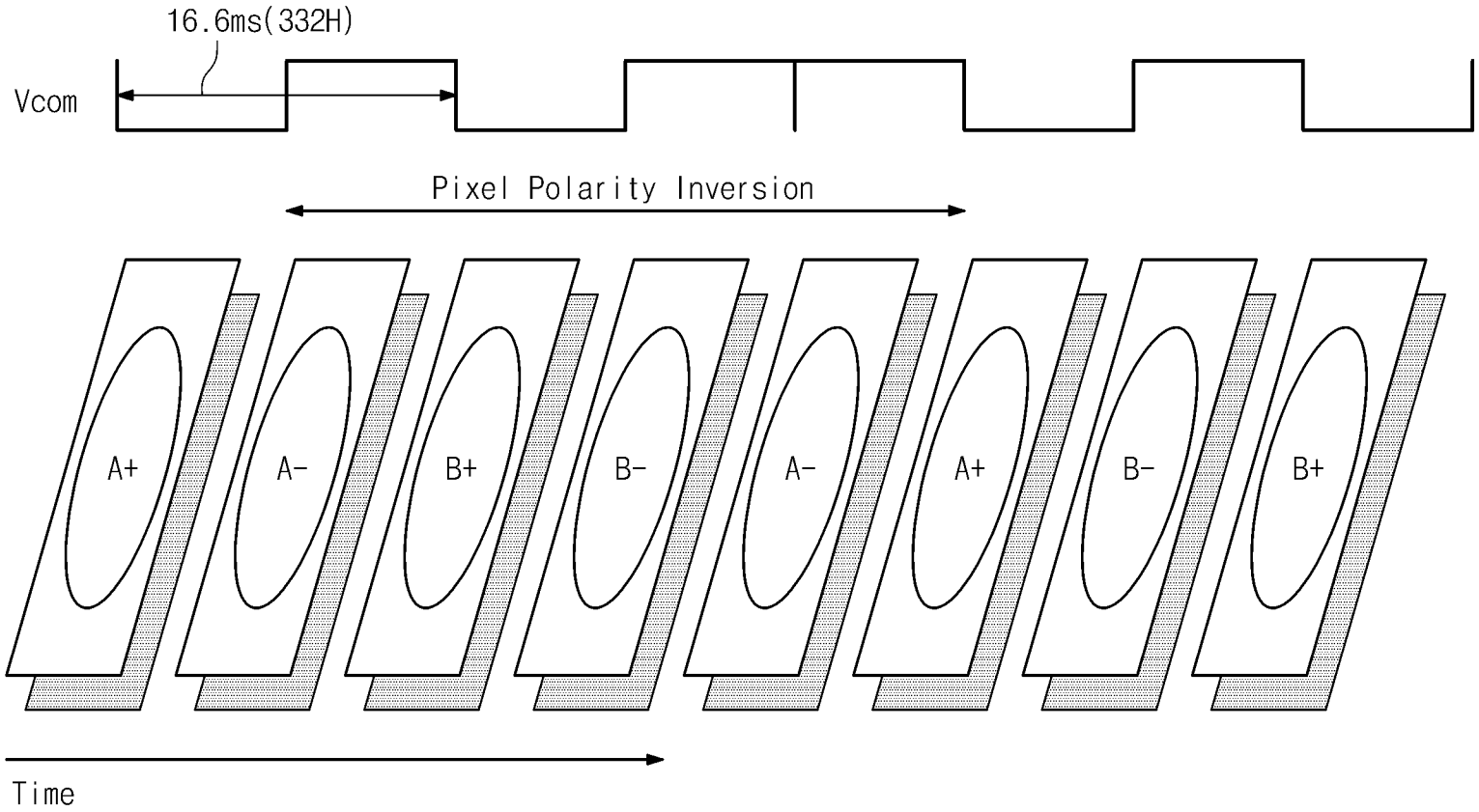
FIG. 7 is a timing diagram illustrating a dot inversion driving method according to the first exemplary embodiment of the present invention in FIG. 1.

FIG. 7 is a timing diagram illustrating a dot inversion driving method according to the first exemplary embodiment of the present invention in FIG. 1. More specifically, FIG. 7 illustrates a dot inversion driving method in which a polarity of the common electrode voltage Vcom is inverted to control a polarity of the pixel sets A and B. More specifically, as shown in FIG. 7, a polarity of image data supplied to the pixel sets A and B is positive, denoted by a plus sign ("+") in FIG. 7, when the common electrode voltage Vcom is low. Conversely, a polarity of image data supplied to the pixel sets A and B is negative, denoted by a minus sign ("−") in FIG. 7, when the common electrode voltage Vcom is high, e.g., a polarity of the common electrode voltage Vcom is inverted with respect to the polarity of the common electrode voltage Vcom when the polarity of image data supplied to the pixel sets A and B is positive.

Thus, referring to FIG. 7, a polarity of each of the pixels sets A and B is inverted every 16.6 ms (332H) driving period, according to a polarity inversion of the common electrode voltage Vcom. More specifically, the polarity of image data written in the pixel sets A and B is inverted from positive to negative during each 16.6 ms driving period (332H) driving period in which two odd-numbered gate lines two even-numbered gate lines are driven, and the polarity of image data written in the pixel sets A and B is inverted from negative to positive during subsequent 16.6 ms (332H) driving periods in which two subsequent odd-numbered gate lines and two subsequent even-numbered gate lines are driven, as shown in FIG. 7. Put another way, in the first exemplary embodiment, a polarity of image data supplied to the pixel sets A and B is inverted once every two driving periods of 16.6 ms (332H), in which four pixels, e.g., two pixel sets A and two pixel sets B, are driven.

Hereinafter, an operation of the LCD 1 according to the first exemplary embodiment of the present invention will be described in further detail with reference to the timing diagram of FIG. 8. As described above, a time period during which the first gate driver group 400 or the second gate driver group 500 is driven twice is 16.6 ms (332H) shown in FIG. 8(*d*). The 332H includes a retracing period of a gate line not shown in FIG. 2. Therefore, since 320H denotes an image display period according to the pixel alignment in FIG. 2, remaining 12H becomes the retracing period.

Alternative exemplary embodiments of the present invention are not limited to the pixel alignment shown in FIG. 2.

Figure 8:
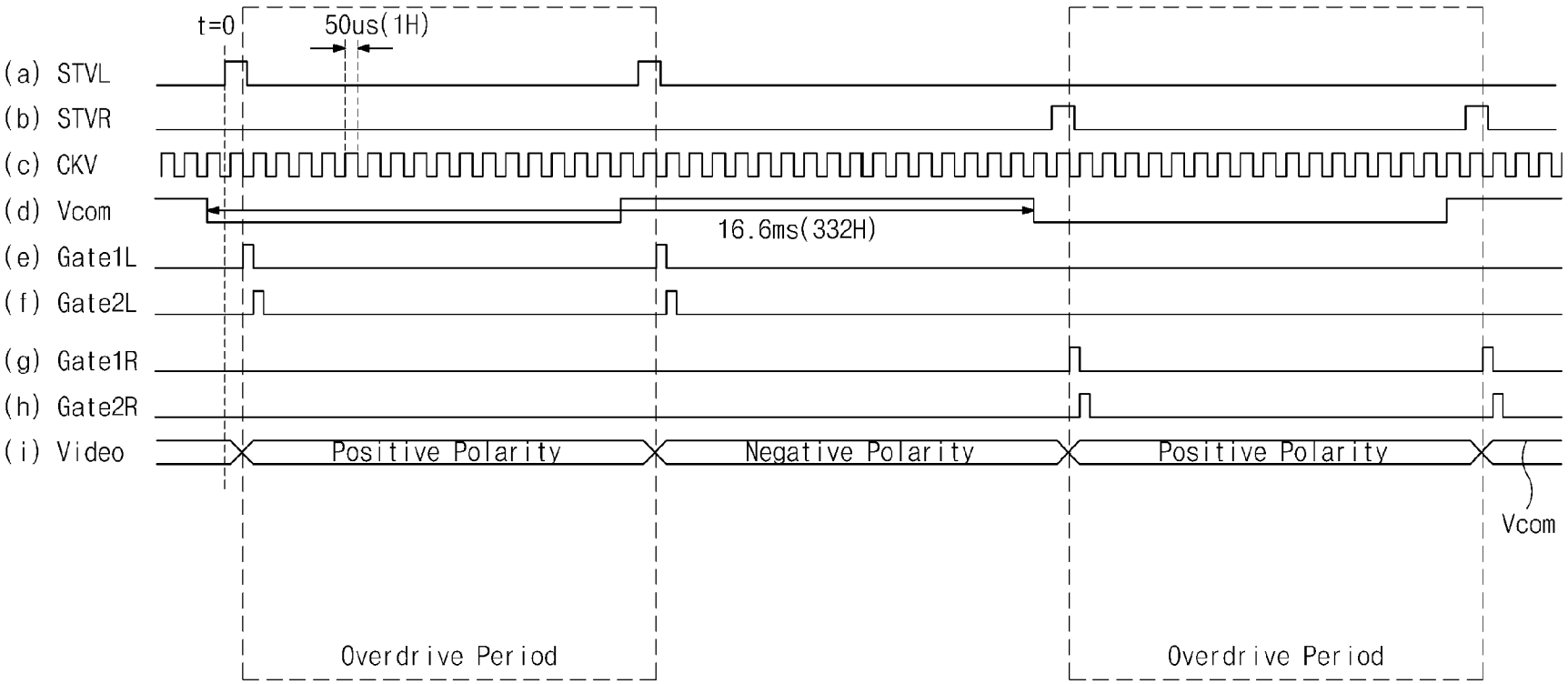
FIG. 8 is a timing diagram illustrating operation of an LCD according to the first exemplary embodiment of the present invention in FIG. 1.

FIG. 8 is a timing diagram illustrating operation of an LCD according to the first exemplary embodiment of the present invention in FIG. 1. In FIG. 8, (a) denotes the first gate start signal STVL input to the first gate driver group 400, (b) denotes the second gate start signal STVR input to the second gate driver group 500, (c) denotes clock signal CKV input to the first gate driver group 400 and the second gate driver group 500, (d) denotes the common electrode voltage Vcom applied to the common electrode, (e) and (f), labeled "Gate1L" and "Gate2L," respectively, denote gate driving signals $G_1$ and $G_3$ (FIG. 1), respectively, output from the first gate drivers G-Dr1L and G-Dr2L (FIG. 2), respectively, in the first gate driver group 400, (g) and (h), labeled "Gate1R" and "Gate2R," respectively, denote gate driving signals $G_2$ and $G_4$ (FIG. 1) output from the second gate drivers G-Dr1R and G-Dr2R (FIG. 2), respectively, in the second gate driver group 500 and (i), labeled "Video," denotes image data input to the source driver 200 (FIGS. 1 and 2).

In FIG. 8(*a*), a first pulse and a second pulse of the first gate start signal STVL are output from the timing controller 100, with an interval of 8.3 ms elapsing between the first pulse and the second pulse of the first gate start signal STVL, in one period of 16.6 ms (332H). Put another way, the second pulse of the first gate start signal STVL starts after 8.3 ms lapses from the first pulse of the first gate start signal STVL at t=0, as shown in FIG. 8.

In FIG. 8(*b*), a first pulse of the second gate start signal STVR is output from the timing controller 100 after 8.3 ms the second pulse of the first gate start signal STVL is output from the timing controller 100. Then, a second pulse of the second gate start signal STVR is output from the timing controller 100 after 8.3 ms the first pulse of the second gate start signal STVR is output from the timing controller 100. For example, referring to the first gate start signal STVL, the second gate start signal STVR is output twice from the timing controller 100 at an interval of 8.3 ms in the period of 16.6 ms (332H) in which the second gate driver group 500 is scanned twice.

As shown in FIG. 8(*c*), one pulse width of the clock signal CKV is equal to one horizontal scanning period 1H, e.g., 50 μs.

Referring to FIG. 8(*d*), a polarity of the common electrode voltage Vcom is inverted every scanning period of 8.3 ms (166H) in which the first gate driver group 400 or the second gate driver group 500 outputs two respective gate driving voltages, e.g., $G_1$ and $G_3$ or $G_2$ and $G_4$, respectively.

Further, the common electrode voltage Vcom is controlled such that an order of polarity inversion of image data is reversed in four subsequent image display periods. For example, a polarity of the common electrode voltage Vcom is inverted from a positive to a negative to a positive to a negative in a first four image display periods, respectively, and from a negative to a positive to a negative to a positive, respectively, in a subsequent four image display periods.

In FIGS. 8(*e*) and (*f*), the first gate drivers G-Dr1L and G-Dr2L (FIG. 2) in the first gate driver group 400 (FIG. 1) operate in response to the first gate start signal STVL to output the scanning signals Gate1L and Gate2L to corresponding odd-numbered gate lines as the gate driving voltages $G_1$ and $G_3$ (FIG. 1), respectively.

In a similar manner as shown in FIGS. 8(*g*) and 8(*h*), the second gate drivers G-Dr1R and G-Dr2R in the second gate driver group 500 operate in response to the second gate start signal STVR to output the scanning signals Gate1R and Gate2R to corresponding even-numbered gate lines as the gate driving voltages $G_2$ and $G_4$ (FIG. 1), respectively.

FIGS. 8(*e*) and (*f*) show operation of the first gate drivers G-Dr1L and G-Dr2L in the first gate driver group 400. However, the remaining first gate drivers G-Dr3L, . . . , and G-Dr (n/2)L operate in the same manner as that of the first gate drivers G-Dr1L and G-Dr2L. Likewise, FIGS. 8(*g*) and (*h*) show operation of the second gate drivers G-Dr1R and G-Dr2R in the second gate driver group 500. However, the remaining second gate drivers G-Dr3R, . . . , and G-Dr(n/2)R operate in the same manner as that of the first gate drivers G-Dr1R and G-Dr2R.

Finally, as illustrated in FIG. 8(*i*), a polarity of image data input to the source driver 200 is set by the polarity of the common electrode voltage Vcom. Thus, referring back to FIG. 7, the polarity of the image data supplied to the pixel set A and the pixel set B every driving period is dot-inverted in corresponding periods in which the odd-numbered gate lines are driven.

Figure 9:
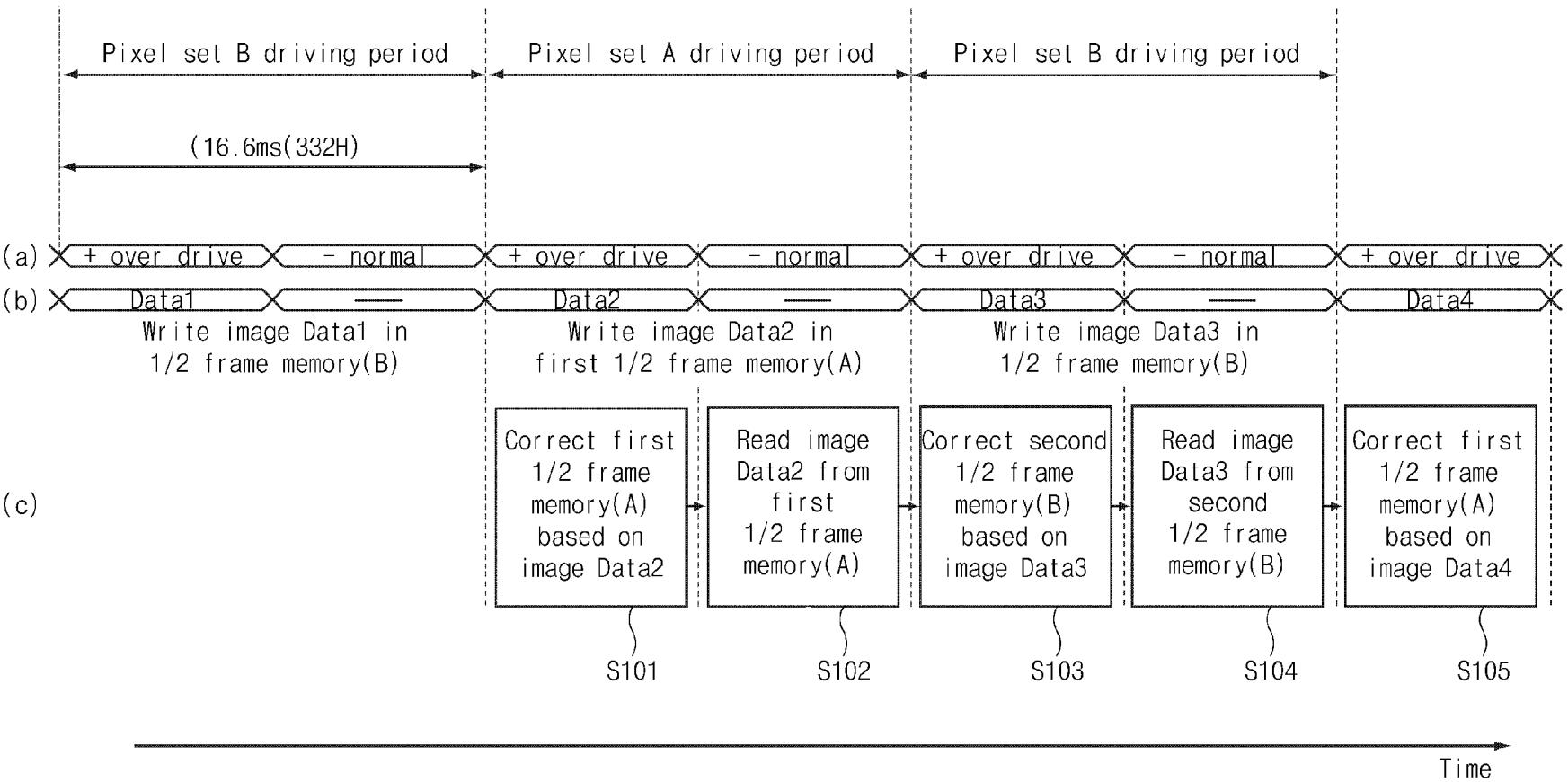
FIG. 9 is a timing diagram illustrating operation of a driving controller according to the first exemplary embodiment of the present invention in FIG. 1.

FIG. 9 is a timing diagram illustrating operation of a driving controller according to the first exemplary embodiment of the present invention in FIG. 1. Hereinafter, the operation of the driving controller 700 will be described in further detail with reference to the timing diagram of FIG. 9.

In FIG. 9, (a) denotes image data output from the driving controller 700 to the source driver 200 (FIG. 1), (b) denotes the image data stored in the first and second ½ frame memories (A) and (B), respectively (FIG. 3), and (c) denotes an operation performed by the driving controller 700 in accordance with the dot inversion driving mode discussed in greater detail above with respect to FIG. 8.

In the driving controller 700 (FIG. 3), the image data input from the timing controller 100 is stored in the line memory 701 in a unit of one line, and the image data stored in the line memory 701 is sequentially stored in the first and second ½ frame memories (A) and (B), respectively, of the frame memory 702 in response to operation of the image input switch 706 according to the first switching signal. Before the driving controller 700 starts the operation illustrated in FIG. 9(*c*), previous ½ screen image data Data1 is stored in the first ½ frame memory (B). Then, the image data Data1 are sequentially stored in the line memory 701 and the first and second ½ frame memories (A) and (B), respectively, of the frame memory 702 according to an operation of the driving controller 700, as shown in FIG. 9.

More specifically, in step S101 of FIG. 9 (*c*), the overdrive voltage selector 703 (FIG. 3) compares a voltage level of the previous image data Data0 (not shown) read from the first ½ frame memory (A) through the image input switch 706 to a voltage level of present image data Data2 read from the line memory 701, and selects an overdrive voltage preset in the LUT 704 based on both an absolute value of the voltage difference obtained through the comparison and a voltage level of the present image data Data2. Next, the overdrive voltage selector 703 adds the selected overdrive voltage to the image data Data2, and provides the DAC 705 (FIG. 3) with the overdriven image data Data2 through the overdrive voltage output switch 708. Then, the first ½ frame memory (A) is corrected based on the present image data Data2 sequentially stored in the line memory 701.

Next, the DAC 705 outputs the overdriven image data Data2 to the source driver 200. The overdriven image data Data2, which is set to a positive polarity according to the polarity of the common electrode voltage Vcom, as described above in reference to FIG. 7, is supplied the pixel set A during the first gate driving period in which the odd-numbered gate lines are driven. Therefore, in step S101, the pixel set A is overdriven to a positive polarity during a first 8.3 ms period of a 16.6 ms (332H) driving period of pixel set A, as shown in FIG. 9(*a*).

In step S102 of FIG. 9, the overdrive voltage selector 703 (FIG. 3) reads the present image data Data2 from the first ½ frame memory (A) through the image input switch 706, and outputs the image data Data2 to the DAC 705 through the overdrive voltage output switch 708.

Next, the DAC 705 outputs normal image data Data2, e.g., image data Data2 which is not overdriven, to the source driver 200. The normal image data Data 2 is set to a negative polarity by the polarity of the common electrode voltage Vcom and are written in the pixel set A corresponding to the second gate driving period during which the odd-numbered gate lines are driven. Thus, in step S102, the normal image Data2 having a negative polarity are supplied to the pixel set A, as shown in FIG. 9(*a*).

Before step S103 starts, the previous image data Data2 is stored in the second ½ frame memory (BA). In step S103, the overdrive voltage selector 703 compares a voltage level of the previous image data Data1 read from the second ½ frame memory (B) through the image input switch 706 with a voltage level of present image data Data3 read from the line memory 701, and selects an overdrive voltage preset in the LUT 704 based on both an absolute value of the voltage difference obtained through the comparison and a voltage level of the present image data Data3. Then, the overdrive voltage selector 703 adds the selected overdrive voltage to the image data Data3 and outputs the overdriven image data Data3 to the DAC 705 through the overdrive voltage output switch 708. Then, the second ½ frame memory (B) is corrected based on the present image data Data3 stored in the line memory 701.

Next, the DAC 705 outputs the overdriven image data Data3 to the source driver 200. The overdriven image data Data3 is set to a positive polarity by a polarity of the common electrode voltage Vcom (FIG. 7) and is supplied to the pixel set B for the first gate driving period during which the even-numbered gate lines are driven. Thus, in step S103, the pixel set B is overdriven to by a negative polarity overdriven image data Data3, as shown in FIG. 9(*a*).

In step S104, the overdrive voltage selector 703 reads the present image data Data3 from the second ½ frame memory (B) through the image input switch 706, and outputs the image data Data3 to the DAC 705 through the overdrive voltage output switch 708.

Next, the DAC 705 outputs normal image data Data3, to which the overdrive voltage is not added, to the source driver 200. The normal image data Data3 is set to a positive polarity by a polarity of the common electrode voltage Vcom and is supplied to the pixel set B for the second gate driving period during which the even-numbered gate lines are driven. Thus, in step S104, the normal image data Data3 having a positive polarity is supplied to the pixel set B, as shown in FIG. 9(*a*).

Before step S105 starts, previously displayed image data Data3 is stored in the first ½ frame memory (B). In step S105, the overdrive voltage selector 703 compares a voltage level of the previous image data Data2 read from the first ½ frame memory (A) through the image input switch 706 with a voltage level of present image data Data4 read from the line memory 701, and selects an overdrive voltage preset in the LUT 704 based on both an absolute value of the voltage difference obtained through the comparison and a voltage level of the present image data Data4. The overdrive voltage selector 703 outputs the image data Data4, to which the selected overdrive voltage is added, as overdriven image data Data4 to the DAC 705 through the overdrive voltage output switch 708. Then, the first ½ frame memory (A) is corrected based on the present image data Data4 stored in the line memory 701.

Next, the DAC 705 outputs the overdriven image data Data4 to the source driver 200. The overdriven image data Data4 is set to a negative polarity by a polarity of the common electrode voltage Vcom and is supplied to the pixel set A for the first gate driving period during which the odd-numbered gate lines are driven. Thus, in step S105, the pixel set A is overdriven by a negative polarity overdriven image data Data4, as shown in FIG. 9(*a*).

Finally, the overdrive voltage selector 703 alternately repeats steps 101 to 104 to display an image on the LCD panel 600 of the LCD 1 according to an exemplary embodiment of the present invention.

According to the first exemplary embodiment of the present invention as described above, the first gate driver group 400, which drives the odd-numbered gate lines, and the second gate driver group 500, which drives the even-numbered gate lines, are disposed at the left and right lateral sides of the LCD panel 600, respectively, and the dot inversion driving mode described above is performed every complete gate driving period of 33.2 ms (664H), e.g., two consecutive driving periods of 16.6 ms (332H) in which the first and second gate driver groups 400 and 500 are each driven twice to supply image data to the pixel sets A and B, respectively. Further, the overdrive driving mode is performed at an interval of the dot inversion driving period in order to set the overdrive voltage based on both the absolute value of the voltage difference between the previous image data and the present image data and the voltage level of the present image data. More specifically, in the overdrive driving mode using the line memory and the ½ frame memories which store the image data corresponding to the ½ screen displayed when the odd-numbered gate lines and the even-numbered gate lines are driven, the image data stored in the line memory is compared with the image data stored in the ½ frame memories, and the overdrive voltage preset in the lookup table is selected based on both the absolute value of the voltage difference obtained through the comparison and the voltage level of the image data corresponding to the ½ screen.

Accordingly, the dot inversion driving method and the overdrive driving method applied to a large-sized TFT LCD panel may also be applied to a medium or small-sized TFT LCD panel. For example, the overdrive voltage for the overdrive driving is preset without installing a plurality of frame memories in order to compare image data, so that the overdrive driving method may be used for the medium or small-sized TFT LCD panel, and a response speed of liquid crystal may be increased, and an image display quality may also be improved while preventing an increase in the size and/or manufacturing cost of the medium or small-sized TFT LCD panel.

Further, in the first exemplary embodiment, the polarity of image data written in the pixel sets A and B is inverted every gate driving period in which the first and second gate driver groups are driven twice, e.g., four times total, but alternate exemplary embodiments are not limited thereto. For example, as illustrated in FIG. 10, which is a timing diagram illustrating a dot inversion driving method according to an alternative exemplary embodiment of the first exemplary embodiment of the present invention in FIG. 1.

Figure 10:
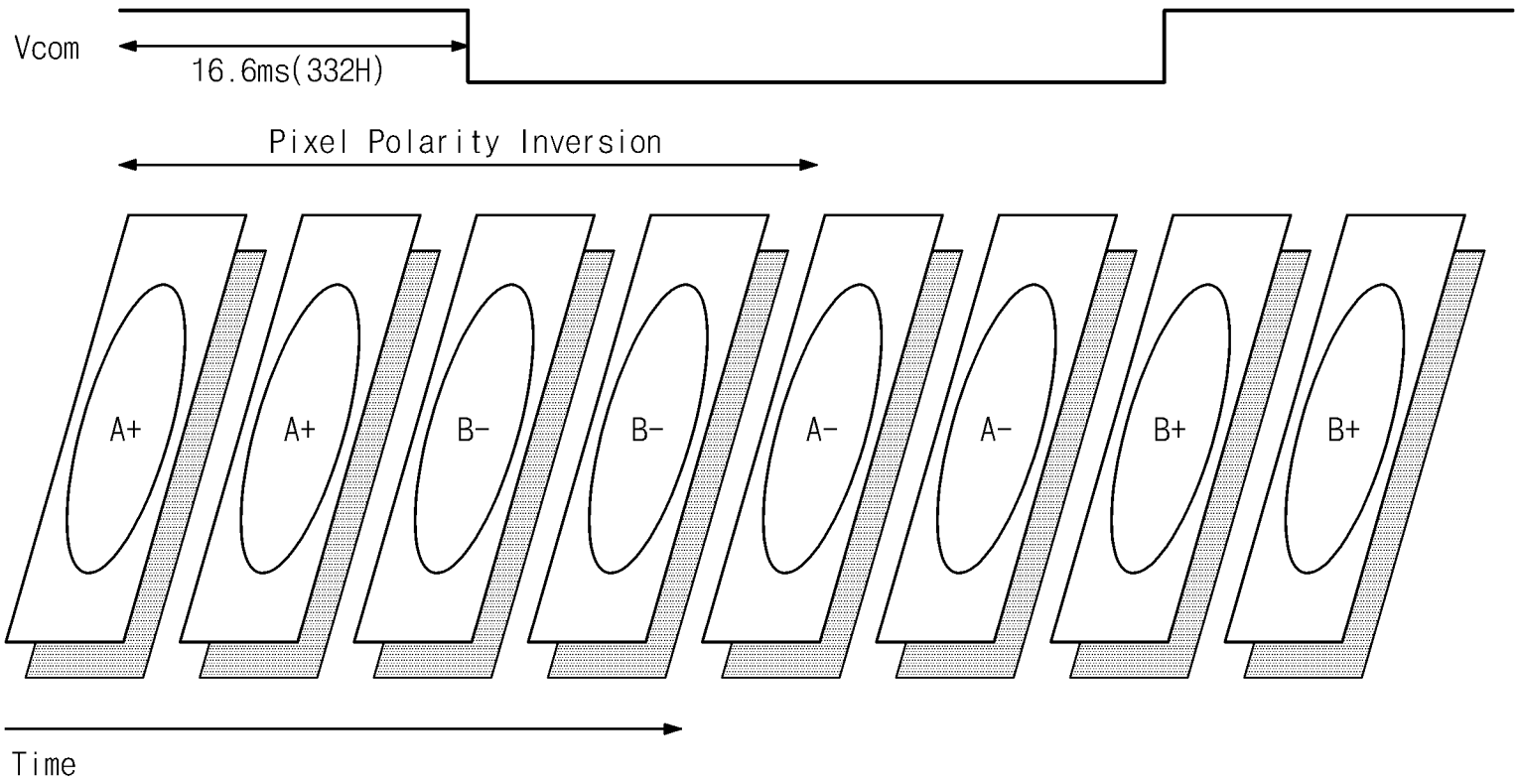
FIG. 10 is a timing diagram illustrating a dot inversion driving method according to an alternative exemplary embodiment of the first exemplary embodiment of the present invention in FIG. 1.

As illustrated in FIG. 10, a polarity of image data supplied to the pixel sets A and B is positive, denoted by a plus sign ("+") in FIG. 10, when the common electrode voltage Vcom is high. Conversely, a polarity of image data supplied to the pixel sets A and B is negative, denoted by a minus sign ("−") in FIG. 7, when the common electrode voltage Vcom is low, e.g., a polarity of the common electrode voltage Vcom is inverted with respect to the polarity of the common electrode voltage Vcom when the polarity of image data supplied to the pixel sets A and B is positive.

Thus, referring to FIG. 10, a polarity of each of the pixels sets A and B is inverted every 16.6 ms (332H) driving period, according to a polarity inversion of the common electrode voltage Vcom. More specifically, the polarity of image data written in the pixel sets A and B is inverted from positive to negative between each 16.6 ms driving period (332H) driving period in which two odd-numbered gate lines two even-numbered gate lines are driven, and the polarity of image data written in the pixel sets A and B is inverted from negative to positive during subsequent 16.6 ms (332H) driving periods in which two subsequent odd-numbered gate lines and two subsequent even-numbered gate lines are driven, as shown in FIG. 10. Put another way, in an alternate exemplary embodiment, a polarity of image data supplied to the pixel sets A and B is inverted once every two driving periods of 16.6 ms (332H), in which four pixels, e.g., two pixel sets A and two pixel sets B, are driven.

As described above in greater detail, the first exemplary embodiment of the present invention employs a dot inversion driving mode in which two odd-numbered gate lines and two even-numbered gate lines are each alternately driven for 16.6 ms (332H), e.g., four gate driving periods or 33.2 ms (664H) total, a polarity of image data is alternately inverted every gate driving period, and an overdrive driving mode is used in which overdriven image data is output in the first gate driving period of each of the two respective gate driving periods of gate drivers which drive the odd-numbered gate lines and the even-numbered gate lines, respectively. A second exemplary embodiment of the present invention, discussed in further detail below, includes the dot inversion driving mode and the and the overdrive driving mode of the first exemplary embodiment. An LCD including a driving controller in the second exemplary embodiment is substantially same as the LCD 1 and the driving controller 700 as described above in greater detail with reference to FIGS. 1 and 3. Therefore, repetitive descriptions of like or similar components will be omitted below.

First, a method of applying the dot inversion driving to the pixel sets A and B in FIG. 5 will be described in further detail with reference to the timing diagram of FIG. 11.

Figure 11:
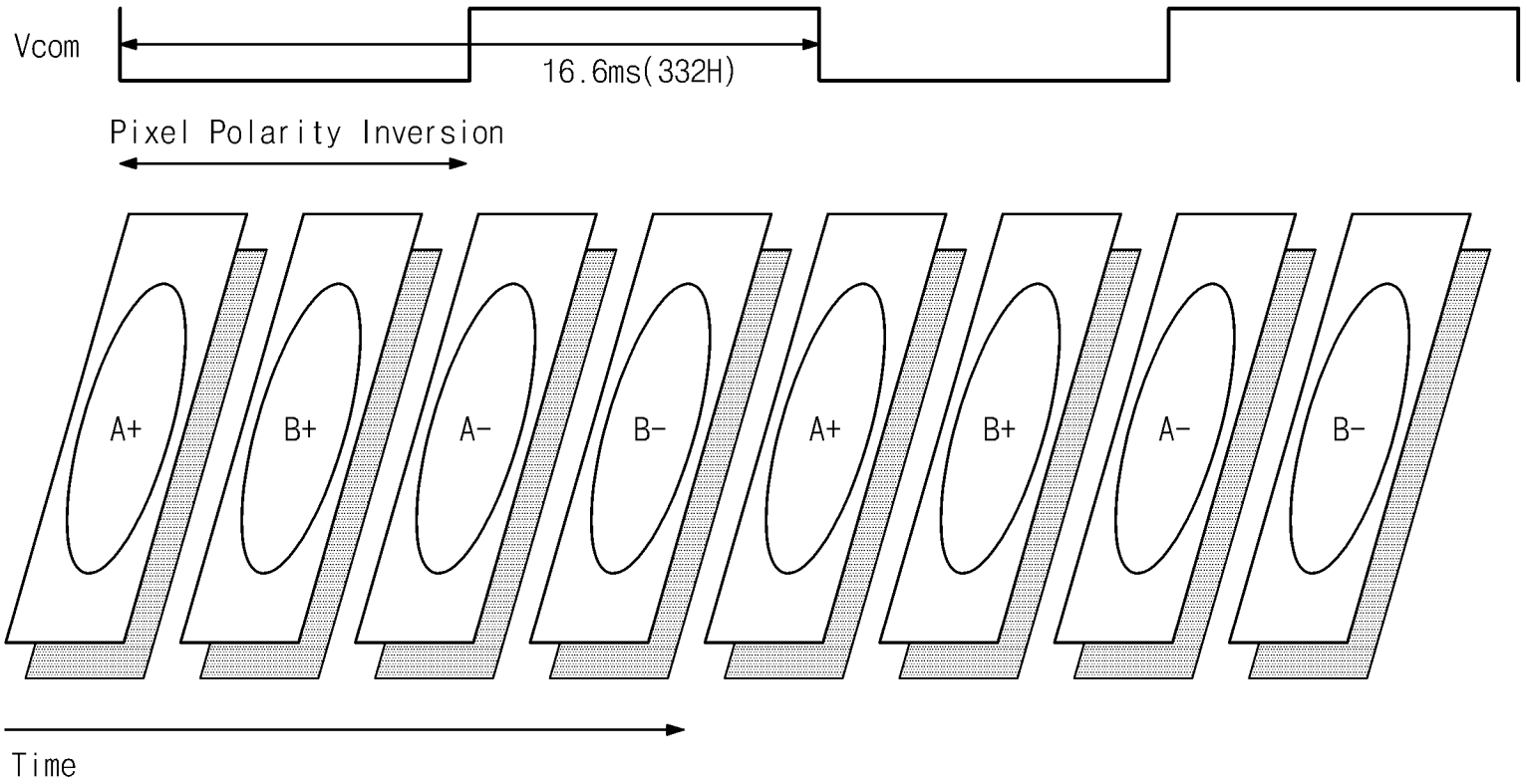
FIG. 11 is a timing diagram illustrating a dot inversion driving method according to a second exemplary embodiment of the present invention.

FIG. 11 is a timing diagram illustrating a dot inversion driving method according to a second exemplary embodiment of the present invention, e.g., a state in which the polarity of the common electrode voltage Vcom is inverted corresponding to the dot inversion driving method of the second exemplary embodiment, and the polarity of image data is inverted every 16.6 ms (332H). Further, odd-numbered gate lines and even-numbered gate lines are alternately driven for 16.6 ms (332H), the polarity of image data supplied to pixel sets A and B has a positive polarity in a first 16.6 ms (332H) period, and a polarity of them image data supplied to pixel sets A and B for a subsequent 16.6 ms (332H) period has a negative polarity, as shown in FIG. 11.

Figure 12:
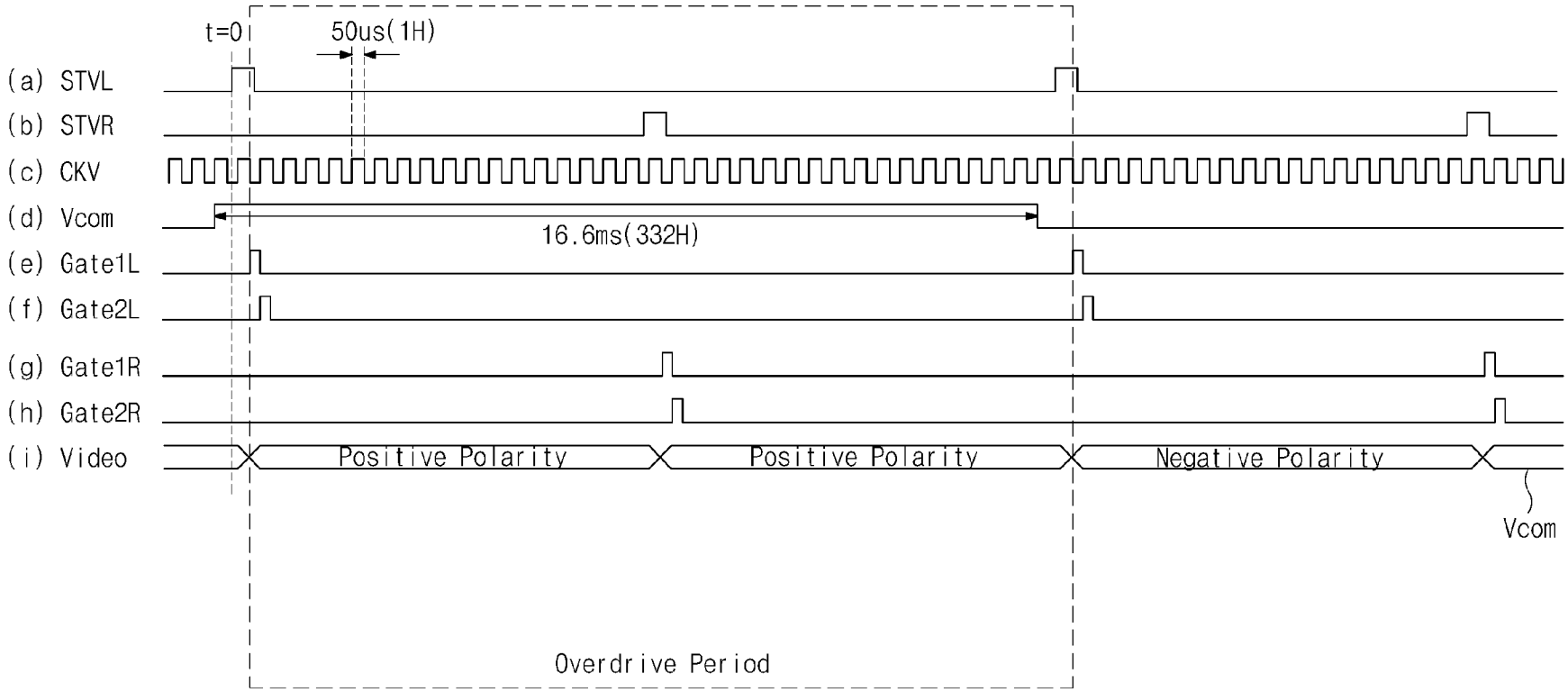
FIG. 12 is a timing diagram illustrating operation of an LCD according to the second exemplary embodiment of the present invention in FIG. 11.

FIG. 12 is a timing diagram illustrating operation of an LCD according to the second exemplary embodiment of the present invention in FIG. 11. Hereinafter, operation of an LCD 1 (FIG. 1) according to the second exemplary embodiment of the present invention will be described with reference to the timing diagram of FIG. 12.

In the second exemplary embodiment, a time period during which the first gate driver group 400 and the second gate driver group 500 are alternately driven is 16.6 ms (332H), as shown in FIG. 12. The 332H includes a retracing period of a gate line (not shown in FIG. 2). Therefore, 320H denotes an image display period according to a pixel alignment in FIG. 2, a remaining 12H of the 332H represents the retracing period.

Alternative exemplary embodiments of the present invention are not limited to the pixel alignment shown in FIG. 2.

In FIG. 12, (a) denotes the first gate start signal STVL input to the first gate driver group 400, (b) denotes the second gate start signal STVR input to the second gate driver group 500, (c) denotes the clock signal CKV input to the first gate driver group 400 and the second gate driver group 500, (d) denotes the common electrode voltage Vcom applied to the common electrode, (e) and (f), labeled Gate1L and Gate2L, respectively, denote gate driving voltages $G_1$ and $G_3$, respectively, output from the first gate drivers G-Dr1L and G-Dr2L, respectively in the first gate driver group 400, (g) and (h), labeled Gate1R and Gate2R, respectively, denote gate driving voltages $G_2$ and $G_4$, respectively, output from the second gate drivers G-Dr1R and G-Dr2R, respectively, from the second gate driver group 500 and (i) denotes image data, labeled Video in FIG. 12, input to the source driver 200.

The first gate start signal STVL shown in FIG. 12(*a*) is output from the timing controller 100 at an interval of 16.6 ms, as shown in FIG. 12(*d*).

The second gate start signal STVR is output from the timing controller 100 8.3 ms after a first pulse of the first gate start signal STVL is output, and is then outputted at intervals of 16.6 ms thereafter. As shown in FIG. 12(*c*), one pulse width of the clock signal CKV is equal to one horizontal scanning period 1H (50 μs).

As shown in FIG. 12(*d*), a polarity of the common electrode voltage Vcom is inverted every 16.6 ms (332H).

In FIGS. 12(*e*) and (*f*), the first gate drivers G-Dr1L and G-Dr2L (FIG. 2) in the first gate driver group 400 (FIG. 1) operate in response to the first gate start signal STVL to output the scanning signals Gate1L and Gate2L corresponding to odd-numbered gate lines as the gate driving voltages $G_1$ and $G_3$ (FIG. 1), respectively.

Similarly, as shown in FIGS. 12(*g*) and 12(*h*), the second gate drivers G-Dr1R and G-Dr2R in the second gate driver group 500 operate in response to the second gate start signal STVR to output the scanning signals Gate1R and Gate2R to even-numbered gate lines as the gate driving voltages $G_2$ and $G_4$ (FIG. 1), respectively.

FIGS. 12(*e*) and (*f*) show operation of the first gate drivers G-Dr1L and G-Dr2L in the first gate driver group 400. However, the remaining first gate drivers G-Dr3L, . . . , and G-Dr(n/2)L operate in the same manner as that of the first gate drivers G-Dr1L and G-Dr2L. Likewise, FIGS. 12(*g*) and (*h*) show operation of the second gate drivers G-Dr1R and G-Dr2R in the second gate driver group 500. However, the remaining second gate drivers G-Dr3R, . . . , and G-Dr(n/2)R operate in the same manner as that of the first gate drivers G-Dr1R and G-Dr2R.

As shown in FIG. 12(*i*), a polarity of image data input to the source driver 200 is set by the polarity of the common electrode voltage Vcom. Thus, referring again to FIG. 11, the polarity of the image data supplied to the pixel sets A and B is dot-inverted every 16.6 ms (332H) when the polarity of the common electrode voltage Vcom is inverted, e.g., changes polarity.

Finally, as shown in FIG. 12, the overdrive driving mode is performed in a period of 16.6 ms (332H).

Figure 13:
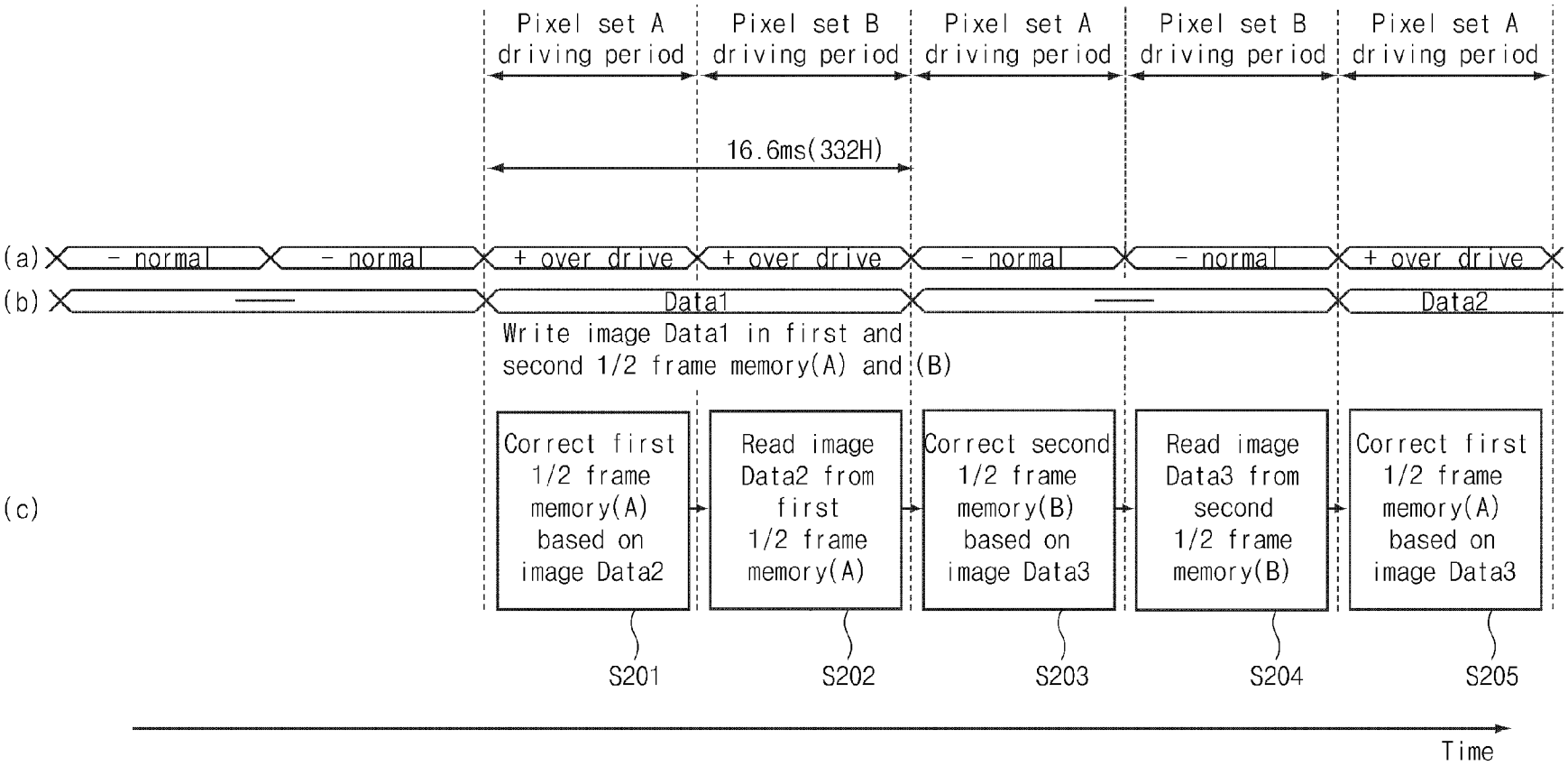
FIG. 13 is a timing diagram illustrating operation of a driving controller according to the second exemplary embodiment of the present invention in FIG. 11.

FIG. 13 is a timing diagram illustrating operation of a driving controller according to the second exemplary embodiment of the present invention in FIG. 11. Hereinafter, operation of the driving controller 700 according to the second exemplary embodiment of the present invention in FIG. 11 will be described in further detail with reference to the timing diagram of FIG. 13.

In FIG. 13, (a) denotes image data output from the driving controller 700 to the source driver 200, (b) denotes the image data stored in the first and second ½ frame memories (A) and (B), respectively (FIG. 3), and (c) denotes an operation performed by the driving controller 700 in accordance with the dot inversion driving mode discussed in greater detail above with respect to FIG. 12.

In the driving controller 700 (FIG. 3), the one line image data input from the timing controller 100 is stored in the line memory 701, and the image data stored in the line memory 701 is sequentially stored in the first and second ½ frame memories (A) and (B), respectively, of the frame memory 702 in response to operation of the image input switch 706 according to the first switching signal. Before the driving controller 700 starts the operation illustrated in FIG. 13(*c*), previous image data Data1 is stored in the first ½ frame memory (A) and the first ½ frame memory (B), and the image data Data2 of one line are stored in the frame memory 701 based on present image data Data2. Then, subsequent image data is sequentially stored in the line memory 701 and the first and second ½ frame memories (A) and (B), respectively, in the frame memory 702 according to the operation of the driving controller 700, described in further detail below.

In step S201 of FIG. 13(*c*), the overdrive voltage selector 703 compares a voltage level of the previous image data Data1 read from the first ½ frame memory (A) through the image input switch 706 with a voltage level of the present image data Data2 read from the line memory 701, and selects an overdrive voltage preset in the LUT 704 based on both an absolute value of a voltage difference obtained through the comparison and the voltage level of the present image data Data2. The overdrive voltage selector 703 outputs overdriven image data2, to which the selected overdrive voltage is added, to the DAC 705 through the overdrive voltage output switch 708. Then, the first ½ frame memory (A) is corrected based on present image data Data2 stored in the line memory 701.

Next, the DAC 705 outputs the overdriven image data Data2 to the source driver 200. The overdriven image data Data2 has a positive polarity according to a polarity of the common electrode voltage Vcom and is supplied to the pixel set A for the driving period during which the odd-numbered gate lines are driven. Thus, in step S201, the pixel set A is overdriven with a positive polarity overdriven image data Data2.

In step S202, the overdrive voltage selector 703 compares a voltage level of the previous image data Data1 read from the second ½ frame memory (B) through the image input switch 706 with the voltage level of present image data Data2 read from the line memory 701, and selects an overdrive voltage preset in the LUT 704 based on both an absolute value of a voltage difference obtained through the comparison and the voltage level of the present image data Data2. The overdrive voltage selector 703 outputs the overdriven present image data Data2 to the DAC 705 through the overdrive voltage output switch 708. Then, the second ½ frame memory (B) is corrected based on the present image data Data2 stored in the line memory 701.

Next, the DAC 705 outputs the overdriven image data Data2 to the source driver 200. The overdriven image data Data2 has a positive polarity according to a polarity of the common electrode voltage Vcom and is supplied to the pixel set B for the driving period during which the even-numbered gate lines are driven. Thus, in step S202, the pixel set B is overdriven with a positive polarity overdriven image data Data2.

In step S203, the overdrive voltage selector 703 reads the present image data Data2 from the first ½ frame memory (A) through the image input switch 706, and outputs the image data Data2 to the DAC 705 through the overdrive voltage output switch 708.

Next, the DAC 705 outputs normal image data Data2, e.g., to which the overdrive voltage is not added, to the source driver 200. The normal image data Data2 has a negative polarity according to a polarity of the common electrode voltage Vcom and is supplied the pixel set A during the second gate driving period in which the odd-numbered gate lines are driven. Thus, in step 203, the normal image data Data2 having a negative polarity is supplied to the pixel set A.

In step S204, the overdrive voltage selector 703 reads the present image data Data2 from the second ½ frame memory (B) through the image input switch 706, and outputs the image data Data2 to the DAC 705 through the overdrive voltage output switch 708.

Next, the DAC 705 outputs normal image data Data2, to which the overdrive voltage is not added, to the source driver 200. The normal image data Data2 has a negative polarity according to a polarity of the common electrode voltage Vcom and is supplied to the pixel set B during the second gate driving period in which the even-numbered gate lines are driven. Thus, in step S204, the normal image data Data2 having a negative polarity is supplied to the pixel set B.

In step S205, the overdrive voltage selector 703 compares a voltage level of previous image data Data2 read from the first ½ frame memory (A) through the image input switch 706 with a voltage level of present image data Data3 read from the line memory 701, and selects an overdrive voltage preset in the LUT 704 based on both an absolute value of a voltage difference obtained through the comparison and a voltage level of the present image data Data3 corresponding. The overdrive voltage selector 703 outputs overdriven image data Data3, to which the selected overdrive voltage is added, to the DAC 705 through the overdrive voltage output switch 708. Then, the first ½ frame memory (A) is corrected based on the present image data Data3 stored in the line memory 701.

Next, the DAC 705 outputs the overdriven image data Data3 to the source driver 200. The overdriven image data Data3 has a positive polarity according to a polarity of the common electrode voltage Vcom and is applied to the pixel set A during a subsequent driving period in which the odd-numbered gate lines are driven. Thus, in step 205, the pixel set A is overdriven with a positive polarity overdriven image data Data3 in a similar manner as in step S201 above.

According to the second exemplary embodiment of the present invention as described above, the first gate driver group 400 which drives the odd-numbered gate lines and the second gate driver group 500 which drives the even-numbered gate lines are disposed at the left and right lateral sides of the LCD panel 600, respectively, and the first gate driver group 400 and the second gate driver group 500 are alternately driven in one period of 16.6 ms (332H) wherein the polarity of the image data applied to the pixel sets A and B is inverted every one period of 16.6 ms (332H). Further, as described above in greater detail, the overdrive driving mode is performed at an interval of 16.6 ms (332H) in order to set the overdrive voltage based on both the absolute value of the voltage difference between the previous image data and the present image data and the voltage level of the present image data. According to the overdrive driving mode using the line memory and the ½ frame memories which store the image data corresponding to ½ screen displayed when the odd-numbered gate lines and the even-numbered gate lines are driven, the image data stored in the line memory is compared with the image data stored in the ½ frame memories, and the overdrive voltage preset in the lookup table 704 is selected based on both the absolute value of the voltage difference obtained through the comparison and the voltage level of the present image data corresponding to the ½ screen.

Therefore, according to the second exemplary embodiment of the present invention, the dot inversion driving method and the overdrive driving methods normally applied to a large-sized TFT LCD panel may also be applied to a medium or small-sized TFT LCD panel, since the overdrive voltage for the overdrive driving is set without installing a plurality of frame memories in order to compare image data, allowing the overdrive driving method to be used for the medium or small-sized TFT LCD panel, thereby increasing a response speed of liquid crystal and an image display quality without an increase in size and/or manufacturing cost of the medium or small-sized TFT LCD panel.

In the first and second exemplary embodiments described in greater detail above, the gate lines in odd-and even-numbered rows are alternately driven twice in a 16.6 ms (332H) period, and the polarity inversion driving mode and the overdrive driving mode are performed every gate driving period within the 16.6 ms (332H) period. In contrast, in a third exemplary embodiment of the present invention, a polarity inversion driving of image data is performed every horizontal scanning period in a gate driving period in which the gate driver is driven in an image display period for displaying one screen, and the overdrive driving mode is performed every gate driving period.

Figure 14:
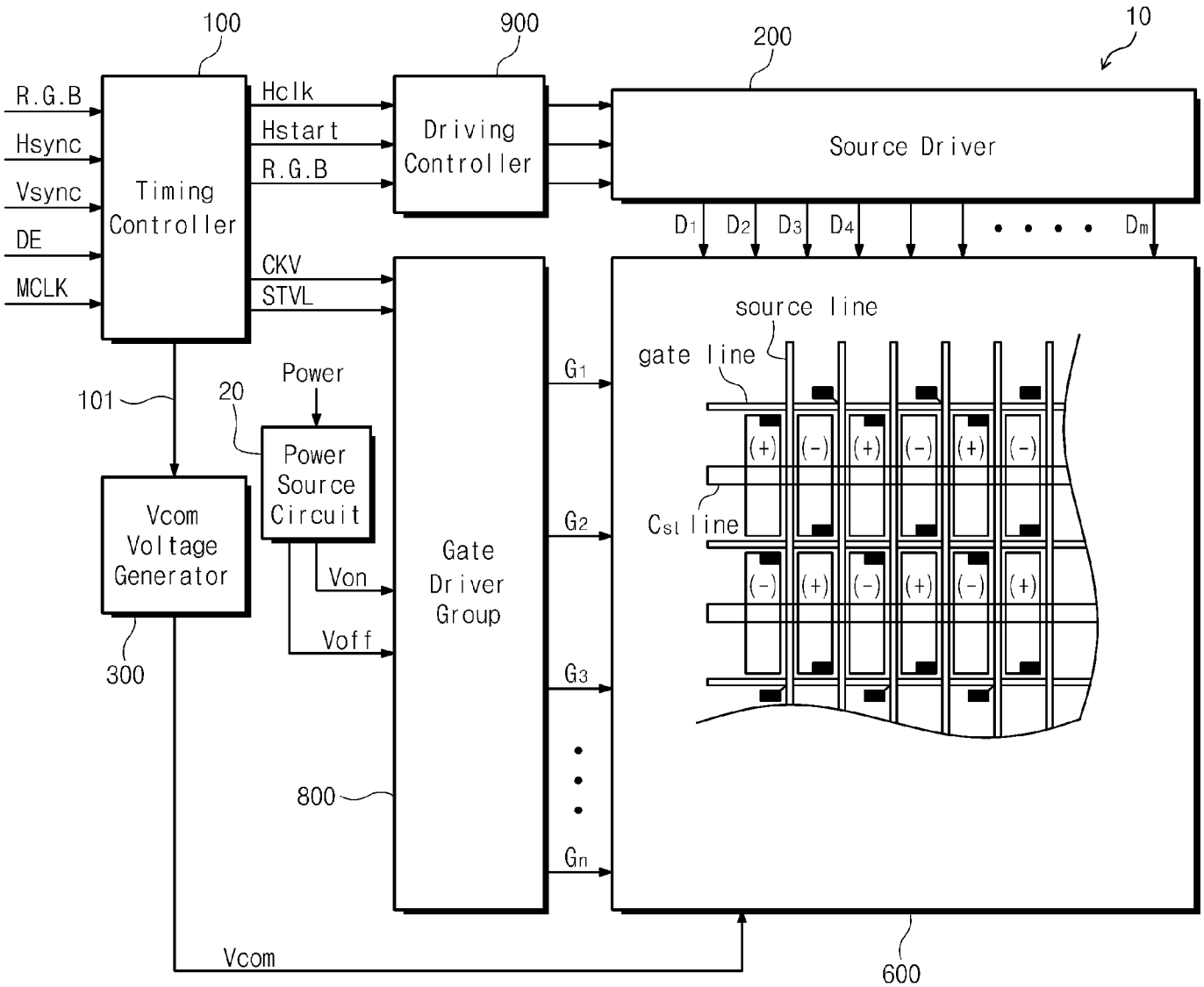
FIG. 14 is a block diagram of an LCD according to a third exemplary embodiment of the present invention.

FIG. 14 is a block diagram of an LCD according to a third exemplary embodiment of the present invention. In FIG. 14, the same reference numerals are assigned to the same or like elements of the LCD 1 shown in FIG. 1, and repetitive descriptions thereof will be omitted below.

Referring to FIG. 14, an LCD 10 includes a power source circuit 20, a timing controller 100, a source driver 200, a gate driver group 800, a Vcom voltage generator 300, an LCD panel 600 and a driving controller 900.

Figure 15:
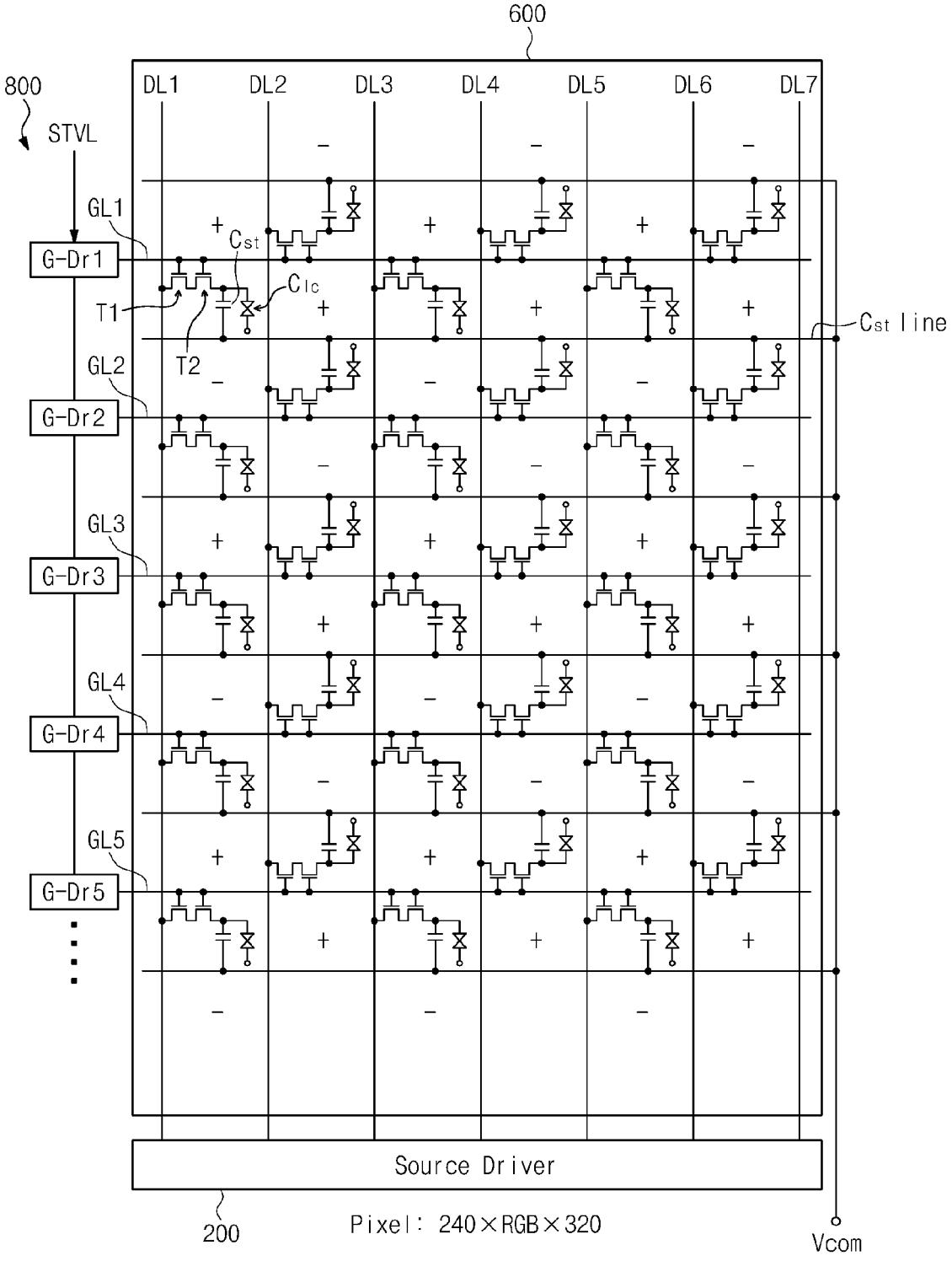
FIG. 15 is a schematic circuit diagram of an LCD panel according to the third exemplary embodiment of the present invention in FIG. 14.

As shown in FIG. 15, which is a schematic circuit diagram illustrating an LCD panel according to the third exemplary embodiment of the present invention in FIG. 14, the gate driver group 800 includes a plurality of gate drivers G-Dr1 to G-Dr(n) in order to drive a plurality of gate lines extending in a first substantially horizontal direction.

Figure 16:
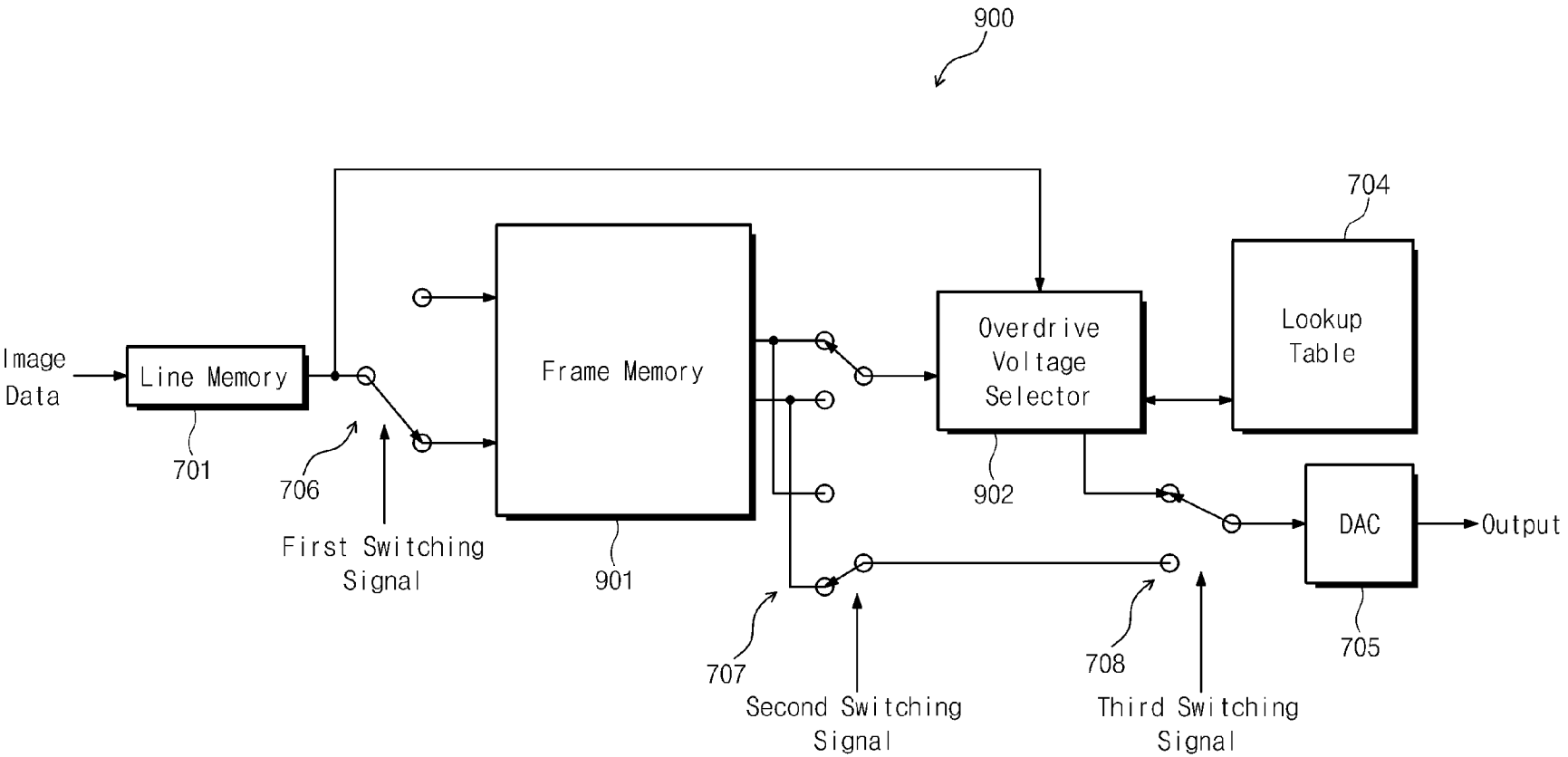
FIG. 16 is a block diagram of a driving controller according to the third exemplary embodiment of the present invention in FIG. 14.

FIG. 16 is a block diagram of a driving controller according to the third exemplary embodiment of the present invention in FIG. 14. Hereinafter, the construction of a driving controller 900 will be described with reference to FIG. 16. In FIG. 16, the same reference numerals are assigned to the same or like elements as those of the driving controller 700 shown in FIG. 3, and repetitive descriptions thereof will be omitted below.

The driving controller 900 includes a line memory 701, a frame memory 901, an overdrive voltage selector 902, an LUT 704, a DAC 705, an image input switch 706, an image output switch 707 and an overdrive voltage output switch 708.

The line memory 901 has a memory area (not shown) which stores one line of image data.

The overdrive voltage selector 902 compares a voltage level of the image data of one line input from the line memory 701 with a voltage level of the present image data of ½ screen input from the image output switch 707, and selects an overdrive voltage preset in the LUT 704 based on both an absolute value of a voltage difference, which is obtained by comparing the two voltage levels, and the voltage level of the present image data of ½ screen, thereby outputting an overdriven image data, to which the selected overdrive voltage is overlapped, to the overdrive voltage output switch 708.

Hereinafter, operation of the LCD 10 according to the third exemplary embodiment of the present invention will be described in further detail.

The LCD 10 employs a dot inversion driving mode, in which the gate driver group 800 is driven during an image display period displaying one screen of image data, and a polarity of the image data is inverted every horizontal scanning period in a gate driving period. The overdriven image data are output to the source driver 200 every gate driving period.

Figure 17:
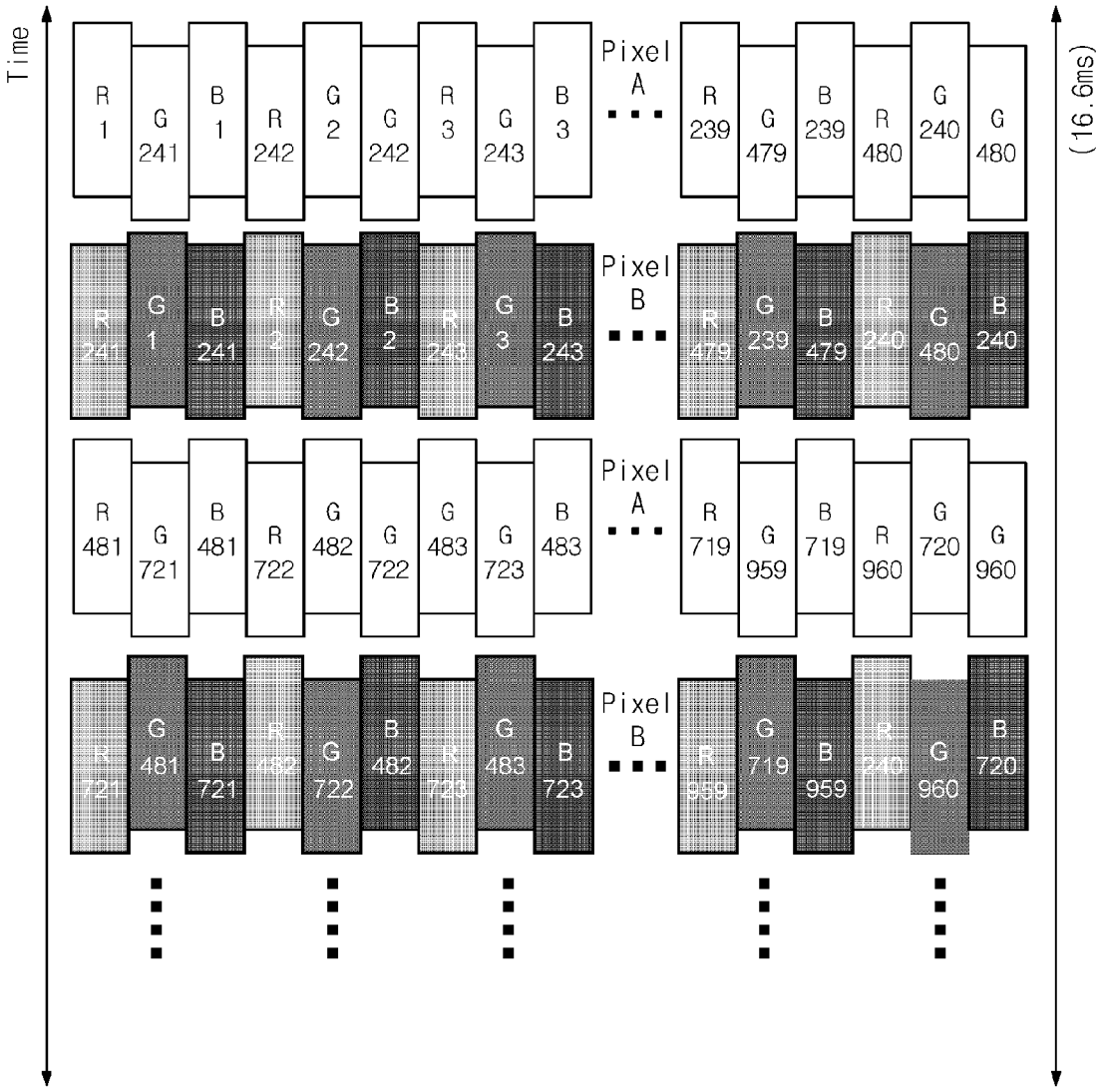
FIG. 17 is a view of a set of pixels illustrating an example of a dot inversion driving method according to the third exemplary embodiment of the present invention in FIG. 14.

FIG. 17 is a view of a set of pixels illustrating one example of a dot inversion driving method according to the third exemplary embodiment of the present invention in FIG. 14, e.g., a case in which the dot inversion driving mode is applied to the pixel sets A and B in FIG. 5.

FIG. 17 shows a sequence of transmitting image signals when odd-numbered gate lines corresponding to the pixel set A and even-numbered gate lines corresponding to the pixel set B are alternately driven during a period of 16.6 ms in which ½ screen of image data is displayed.

Figure 18:
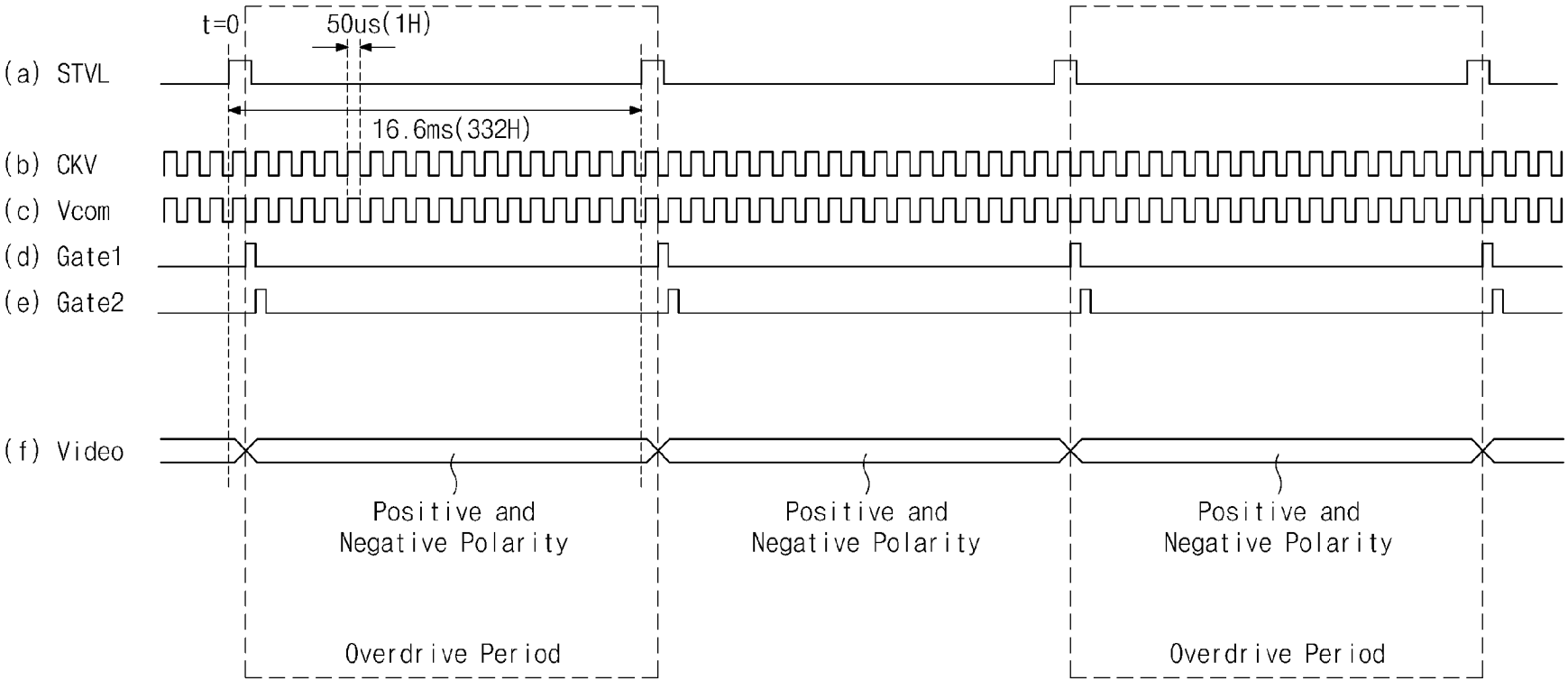
FIG. 18 is a timing diagram illustrating operation of an LCD according to the third exemplary embodiment of the present invention in FIG. 14.

FIG. 18 is a timing diagram illustrating operation of an LCD according to the third exemplary embodiment of the present invention in FIG. 14 Hereinafter, operation of the LCD 10 according to the third exemplary embodiment of the present invention will be described in further detail with reference to the timing diagram of FIG. 18.

In FIG. 18, (a) denotes a gate start signal STVL input to the gate driver group 800, (b) denotes a clock signal CKV input to the gate driver group 800, (c) denotes a common electrode voltage Vcom applied to a common electrode, (d) and (e) denote scanning signals Gate1 and Gate2, respectively, output from the gate drivers G-Dr1 and G-Dr2, respectively, in the gate driver group 800, and (f) denotes image data, labeled Video, input to the source driver 200.

Referring to FIG. 18(*a*), the gate start signal STVL is output from the timing controller 100 at an interval of 16.6 ms, in which an image of one screen is displayed.

In FIG. 18(*b*), in the clock signal CKV, one pulse width is equal to one horizontal scanning period 1H (50 μs). In FIG. 18(*c*), a polarity of the common electrode voltage Vcom is inverted every one horizontal scanning period (1H).

In FIGS. 18(*d*) and (*e*), the gate drivers G-Dr1 and G-Dr2, respectively, in the gate driver group 800 operate in response to the gate start signal STVL, and output the scanning signals Gate1 and Gate2, respectively, to odd-numbered gate lines. FIGS. 18(*d*) and (*e*) show operation of the gate drivers G-Dr1 and G-Dr2 in the gate driver group 800. However, the other gate drivers G-Dr3, . . . , and G-Dr(n) operate in the same manner as that of the gate drivers G-Dr1 and G-Dr2.

In FIG. 18(*f*), a polarity of image data input to the source driver 200 is set according to a polarity of the common electrode voltage Vcom and inverts every horizontal scanning period (1H). Thus, the polarity of the image data written in the pixel sets A and B is dot-inverted every horizontal scanning period, in which the gate lines are driven. Further, the overdrive driving mode is performed for a period of 16.6 ms, as described in further detail below with reference to FIG. 19.

Figure 19:
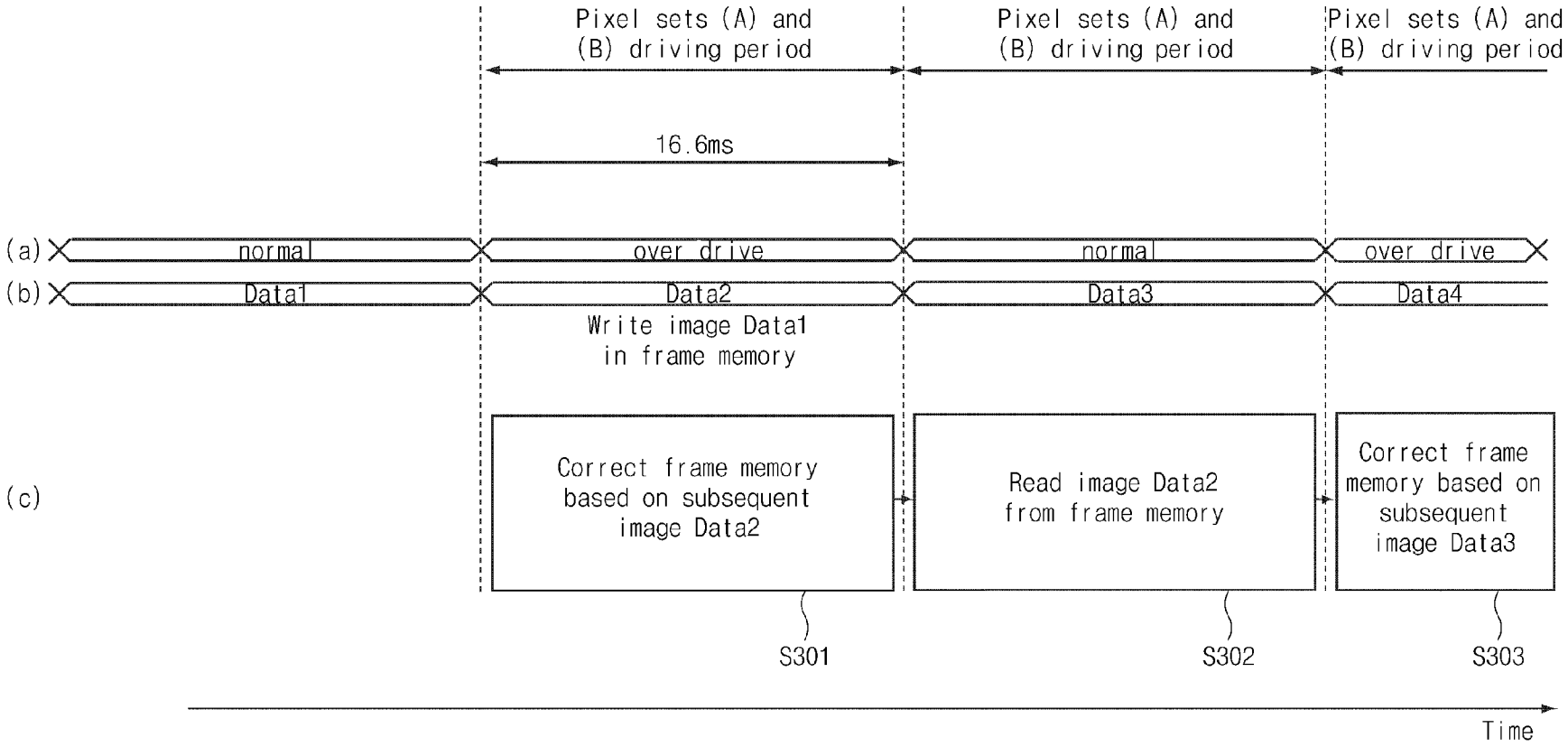
FIG. 19 is a timing diagram illustrating operation of a driving controller according to the third exemplary embodiment of the present invention in FIG. 14.

FIG. 19 is a timing diagram illustrating operation of a driving controller according to the third exemplary embodiment of the present invention in FIG. 14. Hereinafter, the operation of the driving controller 900 according to the third exemplary embodiment of the present invention will be described with reference to the timing chart of FIG. 19.

In FIG. 19, (a) denotes image data output from the driving controller 900 to the source driver 200, (b) denotes the image data stored in the frame memory 901, and (c) denotes steps of an operation performed by the driving controller 900.

In the driving controller 900 of FIG. 16, image data input from the timing controller 100 are stored in the line memory 701 in a unit of one line, and then the image data stored in the frame memory 701 are sequentially stored in the frame memory 901 according to operation of the image input switch 706 according to the first switching signal. Before the driving controller 900 starts the operation of FIG. 19(*c*), previous image data Data1 of the one screen are stored in the frame memory 901, and present image data Data2 of one line are input to the line memory 701 based on the present image data Data2 of one screen to be displayed. Then, subsequent image data is sequentially stored in the line memory 701 and the frame memory 901 according to operation of the driving controller 900.

In step S301 of FIG. 19(*c*), the overdrive voltage selector 902 compares a voltage level of the previous image data Data1 read from the frame memory 901 through the image input switch 706 with a voltage level of the present image data Data2 read from the line memory 701, and selects an overdrive voltage preset in the LUT 704 based on both an absolute value of a voltage difference obtained through the comparison and the voltage level of present the image data Data2. The overdrive voltage selector 902 outputs overdriven present image data Data2, which are overdriven due to the selected overdrive voltage being added thereto, to the DAC 705 through the overdrive voltage output switch 708. Then, the frame memory 901 is corrected based on the present image data Data2 stored in the line memory 701.

Next, the DAC 705 outputs the overdriven image data Data2 to the source driver 200. A polarity of the overdriven image data Data2 is inverted every horizontal scanning period (1H) according to a polarity of the common electrode voltage Vcom and the overdriven image data Data2 is supplied to the pixel sets A and B during a driving period in which the gate lines are driven. Thus, in step S301, the pixel sets A and B are overdriven.

In step S302, the overdrive voltage selector 902 reads the present image data Data2 from the frame memory 901 through the image input switch 706, and outputs the present image data Data2 to the DAC 705 through the overdrive voltage output switch 708.

Next, the DAC 705 outputs normal image data Data2, to which the overdrive voltage is not applied, to the source driver 200. A polarity of the normal image data Data2 is inverted every horizontal scanning period (1H) according to a polarity of the common electrode voltage Vcom and the normal image data Data2 is supplied to the pixel sets A and B during a second gate driving period in which the gate lines are driven. Thus, in step S302, the normal image data Data2 is supplied to the pixel sets A and B.

In step S303, the overdrive voltage selector 902 compares a voltage level of the present image data Data2 read from the frame memory 901 through the image input switch 706 with a voltage level of subsequent image data Data3 read from the line memory 701, and selects an overdrive voltage preset in the LUT 704 based on both an absolute value of a voltage difference obtained through the comparison and the voltage level of the subsequent image data Data3. The overdrive voltage selector 902 outputs overdriven image data Data3, to which the selected overdrive voltage is added, to the DAC 705 through the overdrive voltage output switch 708. Then, the frame memory 901 is corrected based on the subsequent image data Data3 stored in the line memory 701.

Next, the DAC 705 outputs the overdriven image data Data3 to the source driver 200. A polarity of the overdriven image data Data3 is inverted every horizontal scanning period (1H) according to a polarity of the common electrode voltage Vcom and the overdriven image data Data3 is supplied to the pixel sets A and B during a driving period in which the gate lines are driven. Thus, in step S303, the pixel sets A and B are overdriven.

According to the third exemplary embodiment of the present invention as described above, the gate driver group 800 which drives the gate lines is disposed at a left lateral side of the LCD panel 600, and the dot inversion driving mode is performed every horizontal scanning period (1H) in the gate driving period of the one screen during which the gate driver group is driven. Further, the overdrive driving mode is performed in order to set an overdrive voltage for every gate driving period based on both the absolute value of the voltage difference between the present image data and the subsequent image data and the voltage level of image data corresponding to the one screen. According to the overdrive driving mode using the line memory and the frame memory which stores the image data corresponding to one screen displayed when the gate lines in each row are driven, the image data stored in the line memory 701 are compared with the image data stored in the frame memory 901, and the overdrive voltage preset in the lookup table 704 is selected based on both the absolute value of the voltage difference obtained through the comparison and the voltage level of the image data corresponding to one screen.

Accordingly, the dot inversion driving method and the overdrive driving method normally only applied to a large-sized TFT LCD panel may also be applied to a medium or small-sized TFT LCD panel, since the overdrive voltage for the overdrive driving is set without installing a plurality of frame memories in order to compare image data, and the overdrive driving method may thereby be used for the medium or small-sized TFT LCD panel. As a result a response speed of liquid crystal increases and an image display quality is improved without an increase in size and/or manufacturing cost of the medium or small-sized TFT LCD panel. Further, according to the third exemplary embodiment, the gate driver group 800 is disposed at the left lateral side of the LCD panel 600, but is not limited thereto in alternative exemplary embodiments. For example, the driving method of the third exemplary embodiment may be applied whether the gate driver group is installed at the left lateral side or a right lateral side of the LCD panel 600, as in the case of the first exemplary embodiment, described in greater detail above.

In a fourth exemplary embodiment of the present invention, the overdrive voltage selector 902 in FIG. 6 according to the third exemplary embodiment is applied to the LCD 1 according to the first exemplary embodiment shown in FIG. 1, thereby performing both the dot inversion driving mode, in which the polarity of image data is inverted every horizontal scanning period in an image display period of displaying an image of one screen, and the overdrive driving mode at an interval of an image display period.

Since the structure and function of the LCD and the overdrive voltage selector of the fourth exemplary embodiment are the same as those of the LCD 1 and the overdrive voltage selector 902 shown in FIGS. 1 and 16, respectively, repetitive descriptions thereof will hereinafter be omitted.

Figure 20:
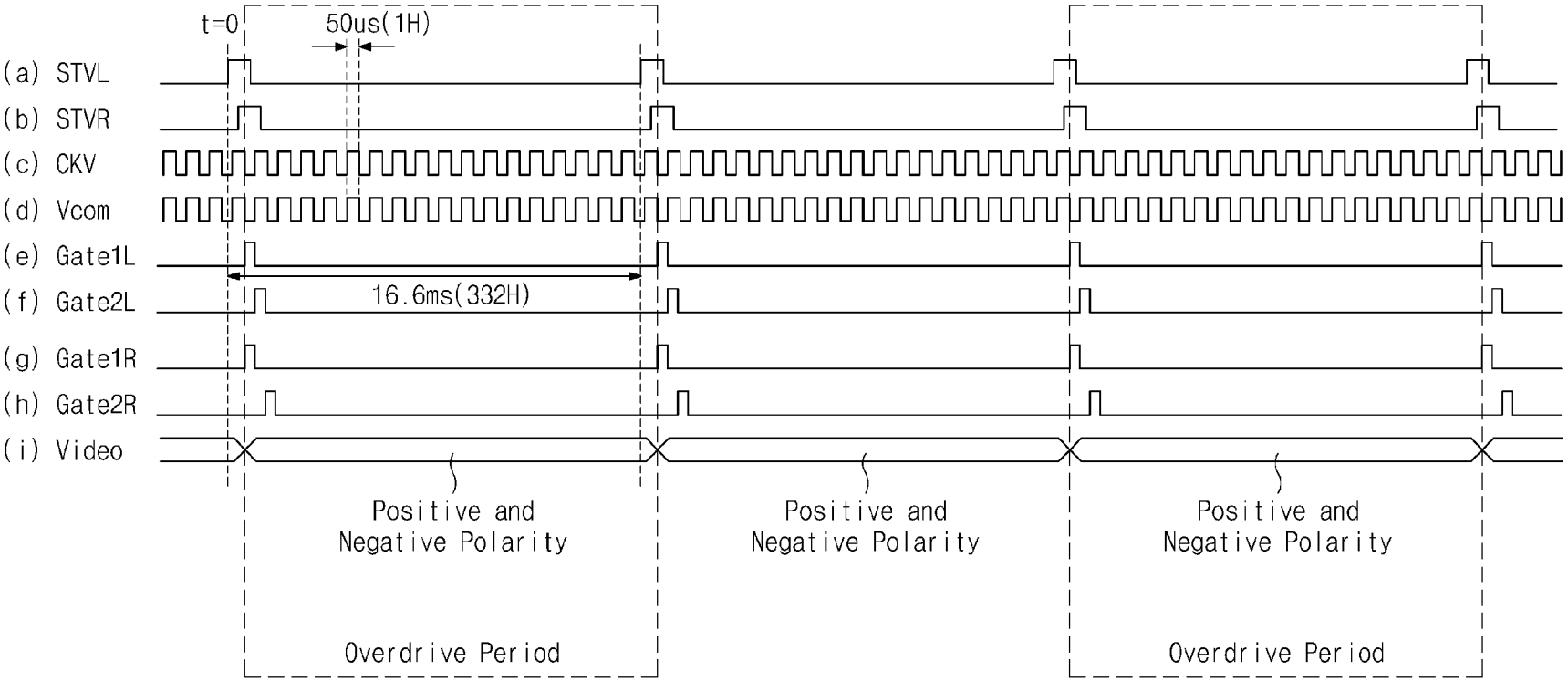
FIG. 20 is a timing diagram illustrating operation of an LCD according to a fourth exemplary embodiment of the present invention.

FIG. 20 is a timing diagram illustrating operation of an LCD according to the fourth exemplary embodiment of the present invention. Hereinafter, the operation of the LCD according to the fourth exemplary embodiment of the present invention will be described with reference to the timing chart of FIG. 20 In FIG. 20, (a) denotes a first gate start signal STVL input to the first gate driver group 400, (b) denotes a second gate start signal STVR input to the second gate driver group 500, (c) denotes a clock signal CKV input to the first gate driver group 400 and the second gate driver group 500, (d) denotes a common electrode voltage Vcom applied to a common electrode, (e) and (f) denote scanning signals Gate1L and Gate2L, respectively, output from the first gate drivers G-Dr1L and G-Dr2L, respectively, in the first gate driver group 400, (g) and (h) denote scanning signals Gate1R and Gate2R, respectively, output from the second gate drivers G-Dr1R and G-Dr2R, respectively, in the second gate driver group 500 and (i) denotes image data input to the source driver 200.

In FIG. 20(*a*), the first gate start signal STVL is output from the timing controller 100 at an interval of 16.6 ms of displaying one screen. In FIG. 20(*b*), a first pulse of the second gate start signals STVR is output from the timing controller 100 after each pulse of the first gate start signals STVL is output. Further, the second gate start signal STVR is output from the timing controller 100 at an interval of 16.6 ms.

In FIG. 20(*c*), in the clock signal CKV, one pulse width is equal to one horizontal scanning period 1H (50 μs), and a number of pulses corresponding to the number of gate lines are output. In FIG. 20(*d*), a polarity of the common electrode voltage Vcom is inverted every one horizontal scanning period (1H).

In FIGS. 20(*e*) and 20(*f*), the first gate drivers G-Dr1L and G-Dr2L in the first gate driver group 400 operate in response to the first gate start signal STVL, and output the scanning signals Gate1L and Gate2L, respectively, to odd-numbered gate lines. In FIGS. 20(*g*) and (*h*), the second gate drivers G-Dr1R and G-Dr2R in the second gate driver group 500 operate in response to the second gate start signal STVR, and output the scanning signals Gate1R and Gate2R, respectively, to even-numbered gate lines. FIGS. 20(*e*) and (*f*) show operations of the first gate drivers G-Dr1L and G-Dr2L in the first gate driver group 400. However, the remaining first gate drivers G-Dr3L, . . . , and G-Dr(n/2)L operate in the same manner as that of the first gate drivers G-Dr1L and G-Dr2L. Similarly, FIGS. 20(*g*) and (*h*) show operations of the second gate drivers G-Dr1R and G-Dr2R in the second gate driver group 500. However, the remaining second gate drivers G-Dr3R, . . . , and G-Dr(n/2)R operate in the same manner as that of the first gate drivers G-Dr1R and G-Dr2R.

In FIG. 20(*i*), a polarity of image data input to the source driver 200 is set according to a polarity of the common electrode voltage Vcom which is inverted every horizontal scanning period (1H) in each driving period of the first gate driver group 400 and the second gate driver group 500. Thus, the polarity of the image data written in the pixel sets A and B is dot-inverted every horizontal scanning period (1H) in the gate driving period during which the odd-numbered gate lines are driven, and the gate driving period during which the even-numbered gate lines driven.

The operation of the driving controller according to the fourth exemplary embodiment of the present invention is the same as that of the driving controller shown in FIG. 19, and repetitive descriptions thereof have been omitted.

According to the fourth exemplary embodiment as described above, the overdrive voltage selector 902 (FIG. 16) according to the third exemplary embodiment is applied to the LCD 1 (FIG. 1) according to the first exemplary embodiment, thereby performing both the dot inversion driving mode, in which the polarity of image data is inverted every horizontal scanning period in an image display period of displaying an image of one screen, and the overdrive driving mode performed at an interval of an image display period.

As a result, the conventional dot inversion driving method and the overdrive driving method applied to a large-sized TFT LCD panel may also be applied to a medium or small-sized TFT LCD panel, since the overdrive voltage for the overdrive driving is set without installing a plurality of frame memories in order to compare image data, so that the overdrive driving method may be used for the medium or small-sized TFT LCD panel, thereby increasing a response speed of liquid crystal may and an image display quality, without an increase in size and/or manufacturing cost of the medium or small-sized TFT LCD panel.

According to exemplary embodiments of the present invention as described above, a the dot inversion driving method and an overdrive driving method normally only applied to large-sized TFT LCD panels may be applied to medium or small-sized TFT LCD panels.

The present invention should not be construed as being limited to the exemplary embodiments set forth herein. Rather, these exemplary embodiments are provided so that this disclosure will be thorough and complete and will fully convey the concept of the present invention to those skilled in the art.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A liquid crystal display comprising:

a plurality of gate lines having odd-numbered gate lines and even-numbered gate lines;

a plurality of source lines;

a first gate driver which drives the odd-numbered gate lines;

a second gate driver which drives the even-numbered gate lines after the first gate driver drives the odd-numbered gate lines;

a driving controller which outputs an overdriven image signal, obtained by adding an overdrive voltage to a normal image signal, in a first sub-driving period of a driving period of a plurality of driving periods of the first gate driver and the second gate driver and outputs the normal image signal in a second sub-driving period which is a remaining driving period of the driving period of the plurality of driving periods of the first gate driver and the second gate driver; and a source driver driving the source lines based on the overdriven image signals and the normal image signals from the driving controller, wherein the first gate driver and the second gate driver drive each of the odd-numbered gate lines and each of the even-numbered gate lines, respectively, twice each per image display period during which image data of one screen are displayed.

2. The liquid crystal display of claim 1, wherein the plurality of gate lines extends in a first direction and the plurality of source lines extends in a second direction substantially perpendicular to the first direction.

3. The liquid crystal display of claim 2, further comprising a plurality of pixels disposed in first columns and second columns, wherein:

the first columns and the second columns are aligned in the second direction;

the first gate driver is installed at an end portion of the odd-numbered gate lines; and the second gate driver is installed at an end portion of the even-numbered gate lines opposite to the end portion of the odd-numbered gate lines.

4. The liquid crystal display of claim 1, wherein:

the overdrive voltage is set according to a level of a normal image signal to be displayed in the second sub-driving period of the driving period of the plurality of driving periods.

5. The liquid crystal display of claim 4, wherein the driving controller comprises:

a frame memory comprising a first memory area and a second memory area, each of which stores a half-screen image signal every driving period of the plurality of driving periods;

a line memory which stores a one-line image signal; and an overdrive voltage setup unit which compares a level of a previous half-screen image signal stored in the first memory area or the second memory area to a level of a present one-line image signal stored in the line memory, and sets the overdrive voltage based on a result obtained by the comparing the level of the previous half-screen image to the level of the present one-line image signal.

6. The liquid crystal display of claim 5, wherein the overdrive voltage setup unit comprises:

an image signal comparator which compares the level of the previous half-screen image signal stored in the first memory area or the second memory area to the level of the one-line image signal stored in the line memory and outputs a voltage difference thereof; and an overdrive voltage storage unit which stores the overdrive voltage based on the voltage difference output from the image signal comparator, an absolute value of the voltage difference output from the image signal comparator and the previous half-screen image signal.

7. The liquid crystal display of claim 5, wherein the driving controller outputs the half-screen image signal stored in the first memory area or the second memory area to the source driver as the normal image signal in the remaining driving periods of the first gate driver and in the remaining driving periods of the second gate driver.

8. The liquid crystal display of claim 7, wherein the driving controller inverts a polarity of the overdriven image signal and a polarity of the normal image signal every driving period of the first gate driver and every driving period of the second gate driver.

9. The liquid crystal display of claim 4, wherein the driving controller inverts a polarity of the overdriven image signal and a polarity of the normal image signal in the first driving period and the second driving period of the plurality of driving periods such that a polarity of the overdriven image signal is opposite to a polarity of the normal image signal during the first driving period and the second driving period.

10. A liquid crystal display comprising:

a plurality of gate lines having odd-numbered gate lines and even-numbered gate lines;

a plurality of source lines;

a first gate driver which divides a scanning period, in which a half-screen image signal is scanned, into a plurality of driving periods having a first driving period and a second driving period, and which drives the odd-numbered gate lines during the first driving period;

a second gate driver which drives the even-numbered gate lines during the second driving period after the first gate driver drives the odd-numbered gate lines;

a driving controller which outputs an overdriven image signal, obtained by adding an overdrive voltage to a normal image signal in a first sub-driving period of a driving period of the plurality of the driving periods and outputs the normal image signal in a second sub-driving period which is a remaining driving period of the driving period of the plurality of driving periods, wherein the overdrive voltage is set according to a level of the normal image signal; and a source driver which drives the source lines based on the overdriven image signal and the normal image signal, wherein the first gate driver and the second gate driver drive each of the odd-numbered gate lines and each of the even-numbered gate lines, respectively, twice each per image display period during which image data of one screen are displayed.

11. The liquid crystal display of claim 10, wherein the plurality of gate lines extends in a first direction and the plurality of source lines extends in a second direction substantially perpendicular to the first direction.

12. The liquid crystal display of claim 10, wherein the first gate driver and the second gate driver alternately drive the odd-numbered gate lines and the even-numbered gate lines, respectively, in the first driving period and the second driving period, respectively, and the driving controller outputs the overdriven image signal to the source driver during the first driving period and outputs the normal image signal to the source driver during the second driving period.

13. The liquid crystal display of claim 10, wherein:

the first gate driver and the second gate driver further divide the scanning period, in which the half-screen image signal is scanned, into the first driving period, the second driving period, a third driving period and a fourth driving period;

the first gate driver and the second gate driver alternately drive the odd-numbered gate lines and the even-numbered gate lines, respectively; and the driving controller outputs the overdriven image signal to the source driver during the first driving period and the second driving period and outputs the normal image signal to the source driver during the third driving period and the fourth driving period.

14. The liquid crystal display of claim 13, wherein the driving controller inverts a polarity of the overdriven image signal and a polarity of the normal image signal every two consecutive driving periods of the first driving period, the second driving period, the third diving period and the fourth driving period.

15. The liquid crystal display of claim 10, wherein the driving controller comprises:

a frame memory comprising a first memory area and a second memory area, each of which stores the half-screen image signal every driving period of the plurality of driving periods;

a line memory which stores a one-line image signal; and an overdrive voltage setup unit which compares a level of a previous half-screen image signal stored in the first memory area or the second memory area to a level of a present one-line image signal stored in the line memory, and sets an overdrive voltage based on a result obtained by the comparing the level of the previous half-screen image to the level of the present one-line image signal.

16. The liquid crystal display of claim 15, wherein the overdrive voltage setup unit comprises:

an image signal comparator which compares the level of the previous half-screen image signal stored in the first memory area or the second memory area to the level of the one-line image signal stored in the line memory, and outputs a voltage difference thereof; and an overdrive voltage storage unit which stores the overdrive voltage based on the voltage difference output from the image signal comparator, an absolute value of the voltage difference output from the image signal comparator and the previous half-screen image level.

17. The liquid crystal display of claim 11, further comprising a plurality of pixels disposed in first columns and second columns, wherein:

the first columns and the second columns are aligned in the second direction;

the first gate driver is installed at an end portion of the odd-numbered gate lines; and the second gate driver is installed at an end portion of the even-numbered gate lines opposite to the end portion of the odd-numbered gate lines.

18. A liquid crystal display comprising:

a plurality of gate lines;

a plurality of source lines;

a gate driver which drives the gate lines in a scanning period during which an image signal of one screen is scanned;

a source driver which drives the source lines based on the image signal; and a driving controller which inverts a polarity of the image signal every horizontal scanning period, wherein the driving controller outputs an overdriven image signal, obtained by adding an overdrive voltage to a normal image signal, to the source driver in the scanning period during the plurality of the horizontal scanning period for which the image signal is displayed wherein the gate driver includes a first gate driver and a second gate driver which drive each of the odd-numbered gate lines and each of the even-numbered gate lines, respectively, twice each per image display period during which image data of one screen are displayed, the second gate drives the even-numbered gate lines after the first gate driver drives the odd-numbered gate lines.

19. The liquid crystal display of claim 18, wherein the plurality of gate lines extends in a first direction and the plurality of source lines extends in a second direction substantially perpendicular to the first direction.

20. The liquid crystal display of claim 18, wherein the driving controller comprises:

a frame memory which stores an image signal of one screen;

a line memory which stores an image signal of one line; and an overdrive voltage setup unit which compares a level of a previous image signal of one screen stored in the frame memory to a level of a present image signal of one line stored in the line memory and sets an overdrive voltage based on a result obtained by comparing the level of the previous image signal of one screen to the level of the present image signal of one line.

21. The liquid crystal display of claim 20, wherein the overdrive voltage setup unit comprises:

an image signal comparator which compares the level of the image signal of one screen stored in the frame memory to the level of the image signal of one line stored in the line memory, and outputs a voltage difference thereof; and an overdrive voltage storage unit which stores the overdrive voltage based on the voltage difference output from the image signal comparator, an absolute value of the voltage difference output from the image signal comparator and the level of the previous image signal of one screen.

22. The liquid crystal display of claim 19, further comprising a plurality of pixels disposed in first columns and second columns, wherein:

the first columns and the second columns are aligned in the second direction; and the gate driver is disposed at an end portion of the gate lines.

23. A method of driving a liquid crystal display, the method comprising:

driving odd-numbered gate lines;

driving even-numbered gate lines after the driving the odd-numbered gate lines;

outputting an overdriven image signal, obtained by adding an overdrive voltage to a normal image signal, in a first sub-driving period of a driving period of a plurality of driving periods of the odd-numbered gate lines and the even-numbered gate lines;

outputting the normal image signal in a second sub-driving period which is a remaining driving periods of the driving period of the plurality of driving periods of the odd-numbered gate lines and the even-numbered gate lines, wherein the overdrive voltage is set according to a level of the normal image signal; and driving source lines based on the overdriven image signals and the normal image signals, wherein the first gate driver and the second gate driver drive each of the odd-numbered gate lines and each of the even-numbered gate lines, respectively, twice each per image display period during which image data of one screen are displayed.

24. The method of claim 23, wherein the overdriven image signal is outputted during a first driving period of the plurality of driving periods, and the overdrive voltage is set according to a level of a normal image signal to be displayed in a second driving period of the plurality of driving periods.

* * * * *